US012569740B2

(12) United States Patent
Rancourt et al.

(10) Patent No.: US 12,569,740 B2
(45) Date of Patent: Mar. 10, 2026

(54) SYSTEM AND METHOD FOR DETERMINING THE MAXIMUM RUNNING SPEED OF A RUNNER AND USES THEREOF

(71) Applicant: SOCPRA SCIENCES ET GÉNIE S.E.C., Sherbrooke (CA)

(72) Inventors: Denis Rancourt, Sherbrooke (CA); Maxime Rancourt, Sherbrooke (CA); Yves St-Amant, Lévis (CA); Clément Ouellet-Léveillé, Sherbrooke (CA); Charles Khazoom, Chambly (CA); Mathieu Léonard, St-Rémi (CA); Alexia Mahlig, Gatineau (CA); Charles-Étienne Tremblay, St-Augustin de Desmaures (CA); Émile Veilleux, Oka (CA)

(73) Assignee: SOCPRA SCIENCES ET GÉNIE S.E.C., Sherbrooke (CA)

( * ) Notice: Subject to any disclaimer, the term of this patent is extended or adjusted under 35 U.S.C. 154(b) by 223 days.

(21) Appl. No.: 18/036,812

(22) PCT Filed: Nov. 13, 2021

(86) PCT No.: PCT/CA2021/051615
§ 371 (c)(1),
(2) Date: May 12, 2023

(87) PCT Pub. No.: WO2022/099423
PCT Pub. Date: May 19, 2022

(65) Prior Publication Data

US 2024/0017146 A1 Jan. 18, 2024

Related U.S. Application Data

(60) Provisional application No. 63/114,429, filed on Nov. 16, 2020.

(51) Int. Cl.
*A63B 69/00* (2006.01)

(52) U.S. Cl.
CPC ..... *A63B 69/0028* (2013.01); *A63B 2230/00* (2013.01)

(58) Field of Classification Search
CPC ..... A63B 69/0028; A63B 2230/00
(Continued)

(56) References Cited

U.S. PATENT DOCUMENTS 11,673,015 B2 * 6/2023 Weck ..... A63B 21/00196 482/74
2011/0208444 A1 8/2011 Solinsky
(Continued)

OTHER PUBLICATIONS

Korhonen, Marco T. et al; "Biomechanical and Skeletal Muscle Determinants of Maximum Running Speed with Aging"; Medicine & Science In Sports & Exercise; vol. 41, No. 4; pp. 844-856, Apr. 2009; XP093131735.
(Continued)

*Primary Examiner* — Allen Chan
(74) *Attorney, Agent, or Firm* — PRAXIS

(57) ABSTRACT

A system (10) and a method for determining a maximum miming speed (MRS) of a runner include a memory unit (32) (MU) with miming determinants (30) (RDs) of the runner and venue stored therein. A processor unit (22) (PU), connected to the memory unit (32) (MU), runs a predictive algorithm (24) (PA) using the running 5 determinants (30) (RDs) to determine the maximum running speed of the runner by zeroing a linear momentum balance and an angular momentum balance of the runner, typically over at least a half-running cycle (HRC). An output unit (34) (OU), connected to the processor unit (22) (PU), receives the determined maximum running speed therefrom. The zeroing also allows the determination of a critical 10 ground impulse ratio ($R_{cr}$) of the runner.

23 Claims, 6 Drawing Sheets

(58) Field of Classification Search
USPC ..... 700/91
See application file for complete search history.

(56) References Cited

U.S. PATENT DOCUMENTS

| | | | | |
|---|---|---|---|---|
| 2012/0015779 | A1* | 1/2012 | Powch | G06Q 10/06 482/9 |
| 2016/0081612 | A1* | 3/2016 | Yamamoto | A61B 5/112 600/595 |

OTHER PUBLICATIONS

Bundle, Matthew W.; Hoyt, Reed W.; Weyand, Peter G.; "High-Speed Running Performance: a New Approach to Assessment and Prediction"; Journal of Applied Physiology (www.jap.org); vol. 95, No. 5; pp. 1955-1962, Nov. 2003; XP093131743.

Ingham, Stephen A. et al; "Determinants of 800-m and 1500-m Running Performance Using Allometric Models"; Medicine & Science In Sports & Exercise; vol. 40, No. 2; pp. 345-350, Feb. 2008; XP093131749.

* cited by examiner

SYSTEM AND METHOD FOR DETERMINING THE MAXIMUM RUNNING SPEED OF A RUNNER AND USES THEREOF

CROSS REFERENCE TO RELATED APPLICATIONS

The present application claims the benefit of U.S. provisional patent application No. 63/114,429, filed on Nov. 16, 2020, and which is incorporated herein by reference.

FIELD OF THE INVENTION

The present invention refers to the analysis of a running person, and more particularly to a system that predicts the maximum running speed of a runner and different uses of the system for improving running performance or determining personal running or runner's characteristics. The maximum running speed is predicted by an algorithm that uses a plurality of running determinants, including environmental characteristics, runner's characteristics and runner's control inputs achieved by the runner to control running speed. The algorithm is based on the congruency (or zeroing) of both linear and angular momentum zero balances over a single step defined as a half-running cycle.

BACKGROUND OF THE INVENTION

Many athletes strive to improve maximum running speed (MRS). Yet, the path to increase running speed is not straightforward. Indeed, running is a multivariable problem that includes physical, physiological and motor control principles that all play a role in determining MRS. For instance, R[8] pointed out that MRS would be dependent on runner's mass, while R[20] demonstrated the need for an athlete to tune the stance leg stiffness with running speed. In fact, many reviews have been published over the years (e.g. R[3]; R[21]; R[26]; R[29], 2000; R[15], R[22] or R[9]) recollecting a broad range of running determinants (RDs), including: foot contact time, stride length or frequency, ground impulse magnitude or ratio, leg stiffness, athlete's mass, limb kinematics or kinetics, running economy, metabolic demands, etc. Various devices exist to characterize runner's kinematics and kinetics, providing feedback to the runner of a number of running determinants (RDs). Yet, no set of determinants seems to be recognized as a mean to determine MRS. GPS based systems currently available on the market do provide trajectory and speed data, but those are not meaningful enough to clearly identify how to improve runner's performance.

Accordingly, there is a need for an improved system that could predict MRS as a function of a limited number of RDs. Moreover, there is a need for such system that could also help estimate various runner's characteristics (RCs) that are essential for enabling its predictive capacity. Finally, there is a need for such a system to include optimization and mapping capabilities so as to provide feedback to the runner, in real-time or post performance, on how to change the runner's control inputs (RCIs) or runner's characteristics (RCs) to help improve running speed.

Accordingly, there is a need for an improved system and method for determining the maximum running speed (MRS) of a runner and different uses thereof.

SUMMARY OF THE INVENTION

It is therefore a general object of the present invention to provide an improved system and method for determining the maximum running speed of a runner, and different uses thereof, that obviates at least one of the above-noted drawbacks.

An advantage of the present invention is to provide a system that predicts the steady speed that a runner reaches based on a limited number of RDs, including at least environmental characteristics (ECs), runner's characteristics (RCs) and runner's control inputs (RCIs). That steady speed is considered a MRS for the given set of RDs values considered.

More specifically, in one embodiment, the system reads current ECs and RCs values from a Parameter Database (PD), and RCIs values considered for the runner from a separate Control Inputs Database (CID). It then inputs those values to a processor unit (PU) that computes typically two predictive outcomes (POs): the MRS achieved by the runner and the ground critical impulse ratio $R_{cr}$ required to maintain that speed. The PU computes these POs by establishing a congruency for the speed condition required to obtain a zero linear momentum balance ($v_{LM}$) for a given ground impulse ratio R value, with the speed condition required to obtain a zero angular momentum balance ($v_{AM}$) for the same R value, preferably over at least a half-running cycle. The system further stores the POs values along with the associated ECs, RCs and RCIs values in a separate Performance Result Database (PRD) for future use.

An advantage of the present invention is that the system can be used to provide MRS and $R_{cr}$ feedback to the runner. This can be achieved, for instance, by obtaining RCIs values in real-time through wearable sensors (WSs) or a ground instrumentation unit (GIU). POs time varying values may be fed back to the runner through an electronic display in various forms such as electronic glasses, watches, smart phones or the like. In one embodiment, values are provided to the runner through a speed-ground impulse ratio linear-log map on the electronic display. It can also be provided to the runner through an app for post-performance analysis, or any software platform dedicated to the analysis of the PRD data. In a different embodiment, if either the $R_{cr}$ or the MRS values achieved by a runner are known, the system can use the same congruency algorithm to estimate any one missing value from the RCs or RCIs required data set, while other values are known.

Another advantage of the present invention is that the RCs and RCIs values may be obtained from PD and CID databases that are established from prior data obtained from a given runner population in representative conditions.

According to an aspect of the present invention there is provided a system for determining a maximum running speed (MRS) of a runner as a first predictive outcome (PO), said system comprising:

- a memory unit (MU) having stored therein a plurality of running determinants (RDs) of the runner and venue;
- a processor unit (PU) connecting to the memory unit (MU), the processor unit (PU) running a predictive algorithm (PA) using the plurality of running determinants (RDs) to determine the maximum running speed of the runner by zeroing a linear momentum balance and an angular momentum balance of the runner; and
- an output unit (OU) connecting to the processor unit (PU) to receive the determined maximum running speed therefrom.

In one embodiment, the zeroing of the linear momentum balance and the angular momentum balance allows the processor unit (PU) to determine a critical ground impulse ratio ($R_{cr}$) of the runner as a second predictive outcome (PO) sent to the output unit (OU).

In one embodiment, at least one of the first and second predictive outcomes (PO) is stored in a performance result database (PRD).

In one embodiment, the plurality of running determinants (RDs) are stored in a parameter database (PD) including environmental characteristics (ECs) and runner's characteristics (RCs) and a control inputs database (CID) including runner's control inputs (RCIs).

Conveniently, the environmental characteristics (ECs) include a gravitational acceleration (g), a wind speed ($v_w$), an air density ($\rho$), and track ($Z_{trk}$) and shoe ($Z_{shoe}$) mechanical impedances, wherein the runner's characteristics (RCs) include a body mass (m) of the runner, an effective drag factor ($\alpha$), an effective drag force height ($y_e$), and body segments' lengths, mass, inertia, and center of mass locations of the runner, and wherein the runner's control inputs (RCIs) include one of a contact time ($t_c$) value and a takeoff time period ($\tau_2$) value, an aerial time ($t_a$) value, a landing time period ($\tau_1$) value, and a center of mass speed ratio ($\beta_0$) value.

In one embodiment, the system further comprises:

a ground instrumentation unit (GIU) connecting to the processor unit (PU) to capture motion data from the runner while running at constant speed; wherein the processor unit (PU) receives the captured motion data to determine real-time values of a portion of the plurality of running determinants (RDs) and provide therewith real-time values of the predictive outcomes (PO).

Conveniently, the portion of the plurality of running determinants (RDs) includes at least one of the effective drag factor ($\alpha$), the effective drag force height ($y_e$), one of the contact time ($t_c$) value and the takeoff time period ($\tau_2$) value, the aerial time ($t_a$) value, the landing time period ($\tau_1$) value, and the center of mass speed ratio ($\beta_0$) value.

In one embodiment, the system further comprises:

a system identification unit (SIU) connecting to the processor unit (PU) to receive the predictive outcomes (PO) therefrom, the system identification unit (SIU) estimating at least one of the plurality of running determinants (RDs) and sending the estimated one of the plurality of running determinants (RDs) to the memory unit (MU) connected to the system identification unit (SIU).

In one embodiment, at least one of the plurality of running determinants (RDs) is determined from a plurality of accumulated tabled values from other runners and stored in the performance result database (PRD).

In one embodiment, the system further comprises:

an optimization algorithm (OA) connecting to the performance result database (PRD) to receive data therefrom to determine optimized values of at least one of the plurality of running determinants (RDs) to improve the predictive outcomes (PO) and sending the optimized values to the memory unit (MU) connected to the optimization algorithm (OA).

Conveniently, the plurality of running determinants (RDs) are stored in a parameter database (PD) including environmental characteristics (ECs) and runner's characteristics (RCs) and a control inputs database (CID) including runner's control inputs (RCIs); and wherein the optimization algorithm (OA) determines optimal values of the runner's control inputs (RCIs) to achieve a predetermined value of at least one of the first and second predictive outcomes (PO) using the environmental characteristics (ECs) and runner's characteristics (RCs).

Conveniently, the optimization algorithm (OA) determines optimal values of the environmental characteristics (ECs), runner's characteristics (RCs), and the runner's control inputs (RCIs) to achieve an ultimate predetermined value of at least one of the first and second predictive outcomes (PO).

In one embodiment, the zeroing of the linear momentum balance and the angular momentum balance is performed over at least a half-running cycle (HRC).

According to another aspect of the present invention there is provided a method for determining a maximum running speed (MRS) of a runner as a first predictive outcome (PO), said method comprising the steps of:

getting a plurality of running determinants (RDs) of the runner and venue stored in a memory unit (MU);

running a predictive algorithm (PA) with a processor unit (PU) connected to the memory unit (MU) using the plurality of running determinants (RDs) to determine the maximum running speed of the runner by zeroing a linear momentum balance and an angular momentum balance of the runner; and providing the determined maximum running speed to an output unit (OU) connected to the processor unit (PU).

In one embodiment, the zeroing of the linear momentum balance and the angular momentum balance allows the processor unit (PU) to determine a critical ground impulse ratio ($R_{cr}$) of the runner as a second predictive outcome (PO), and wherein the step of providing comprises providing the second predictive outcome (PO) to the output unit (OU).

In one embodiment, the method further comprises the step of:

storing the at least one of the first and second predictive outcomes (PO) in a performance result database (PRD).

In one embodiment, the plurality of running determinants (RDs) are stored in a parameter database (PD) including environmental characteristics (ECs) and runner's characteristics (RCs) and a control inputs database (CID) including runner's control inputs (RCIs); and wherein the environmental characteristics (ECs) include a gravitational acceleration (g), a wind speed ($v_w$), an air density ($\rho$), and track ($Z_{trk}$) and shoe ($Z_{shoe}$) mechanical impedances, wherein the runner's characteristics (RCs) include a body mass (m) of the runner, an effective drag factor ($\alpha$), an effective drag force height ($y_e$), and body segments' lengths, mass, inertia, and center of mass locations of the runner, and wherein the runner's control inputs (RCIs) include one of a contact time (to) value and a takeoff time period ($\tau_2$) value, an aerial time ($t_a$) value, a landing time period ($\tau_1$) value, and a center of mass speed ratio ($\beta_0$) value; the method further comprising the steps of:

capturing motion data from the runner while running at constant speed using a ground instrumentation unit (GIU) connected to the processor unit (PU);

determining real-time values of a portion of the plurality of running determinants (RDs) with the captured motion data received from the processing unit (PU), and providing therewith real-time values of the predictive outcomes (PO).

Conveniently, the portion of the plurality of running determinants (RDs) includes at least one of the effective drag factor ($\alpha$), the effective drag force height ($y_e$), one of the contact time (to) value and the takeoff time period ($\tau_2$) value, the aerial time ($t_a$) value, the landing time period ($\tau_1$) value, and the center of mass speed ratio ($\beta_0$) value; the method further comprising the step of:

estimating at least one of the plurality of running determinants (RDs) using a system identification unit (SIU)

connected to the processor unit (PU) to receive the predictive outcomes (PO) therefrom, and sending the estimated one of the plurality of running determinants (RDs) to the memory unit (MU) connected to the system identification unit (SIU).

In one embodiment, at least one of the plurality of running determinants (RDs) is determined from a plurality of accumulated tabled values from other runners and stored in the performance result database (PRD).

In one embodiment, the method further comprises the step of:

determining optimized values of at least one of the plurality of running determinants (RDs), using an optimization algorithm (OA) connected to the performance result database (PRD) to receive data therefrom, to improve the predictive outcomes (PO), and sending the optimized values to the memory unit (MU) connected to the optimization algorithm (OA).

Conveniently, the plurality of running determinants (RDs) are stored in a parameter database (PD) including environmental characteristics (ECs) and runner's characteristics (RCs) and a control inputs database (CID) including runner's control inputs (RCIs); the method further comprising the step of:

determining optimal values of the runner's control inputs (RCIs) using the optimization algorithm (OA) to achieve a predetermined value of at least one of the first and second predictive outcomes (PO) using the environmental characteristics (ECs) and runner's characteristics (RCs).

Conveniently, the method further comprises the step of determining optimal values of the environmental characteristics (ECs), runner's characteristics (RCs), and the runner's control inputs (RCIs) using the optimization algorithm (OA) to achieve an ultimate predetermined value of at least one of the first and second predictive outcomes (PO).

In one embodiment, the zeroing includes zeroing of the linear momentum balance and the angular momentum balance over at least a half-running cycle (HRC).

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE INVENTION

With reference to the annexed drawings the preferred embodiments of the present invention will be herein described for indicative purpose and by no means as of limitation.

It is to be noted that all computer technology related terminology or semantic are not described in details herein, and that one skilled in the art would readily understand the scope and be aware of all different technologies applicable to different components of the system and method of the present invention, including all possible communication means usable with the current worldwide computing technology.

Figure 1:
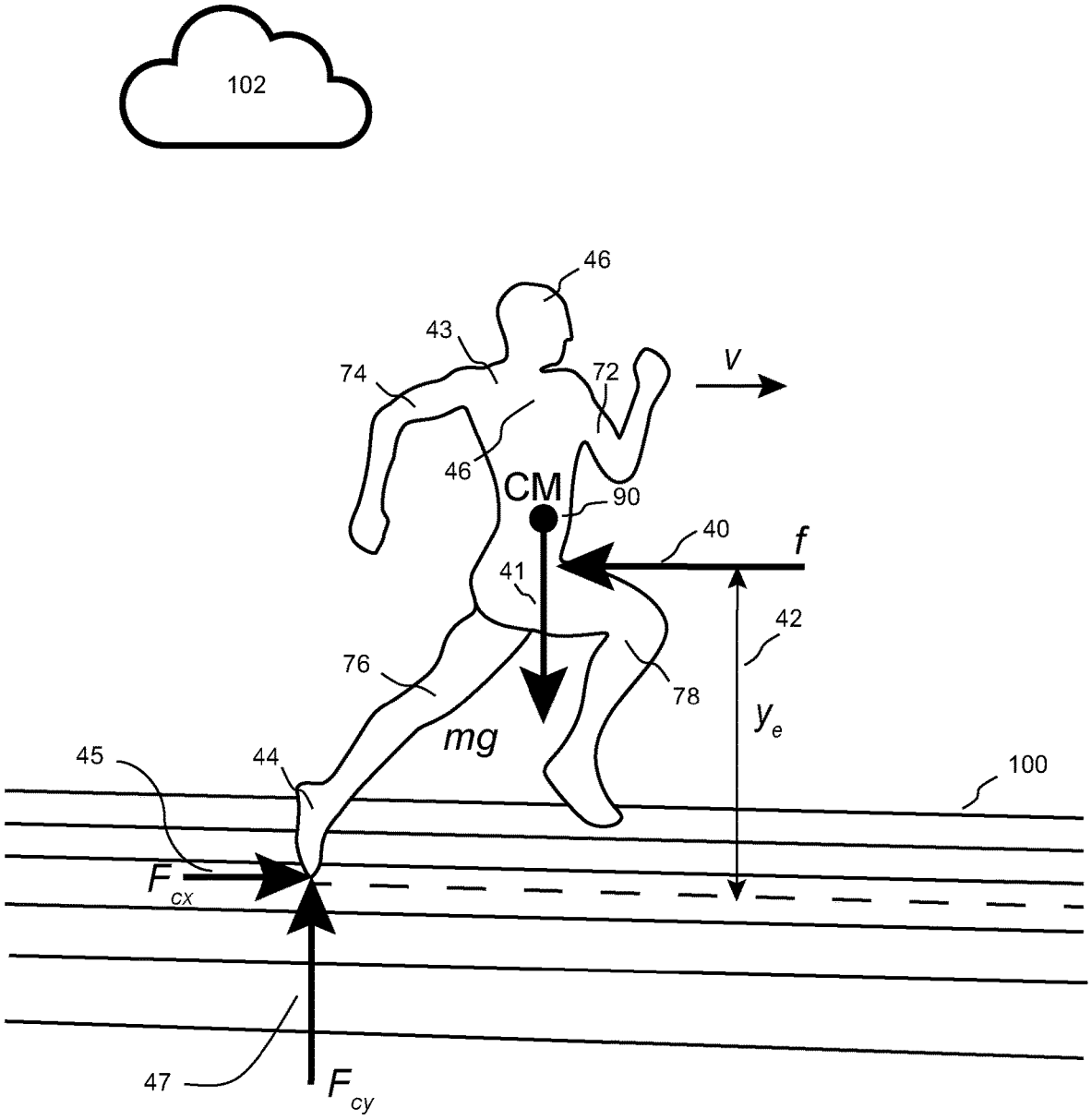
FIG. 1 is a schematic side view of a runner in accordance with an embodiment of the present invention; Free body diagram of an athlete running at steady maximum velocity v, gravitational force mg, ground contact foot horizontal ($F_{cx}$) and vertical ($F_{cy}$) forces, and effective aerodynamic drag force f acting on the runner at an effective drag height $y_e$.
Figure 2:
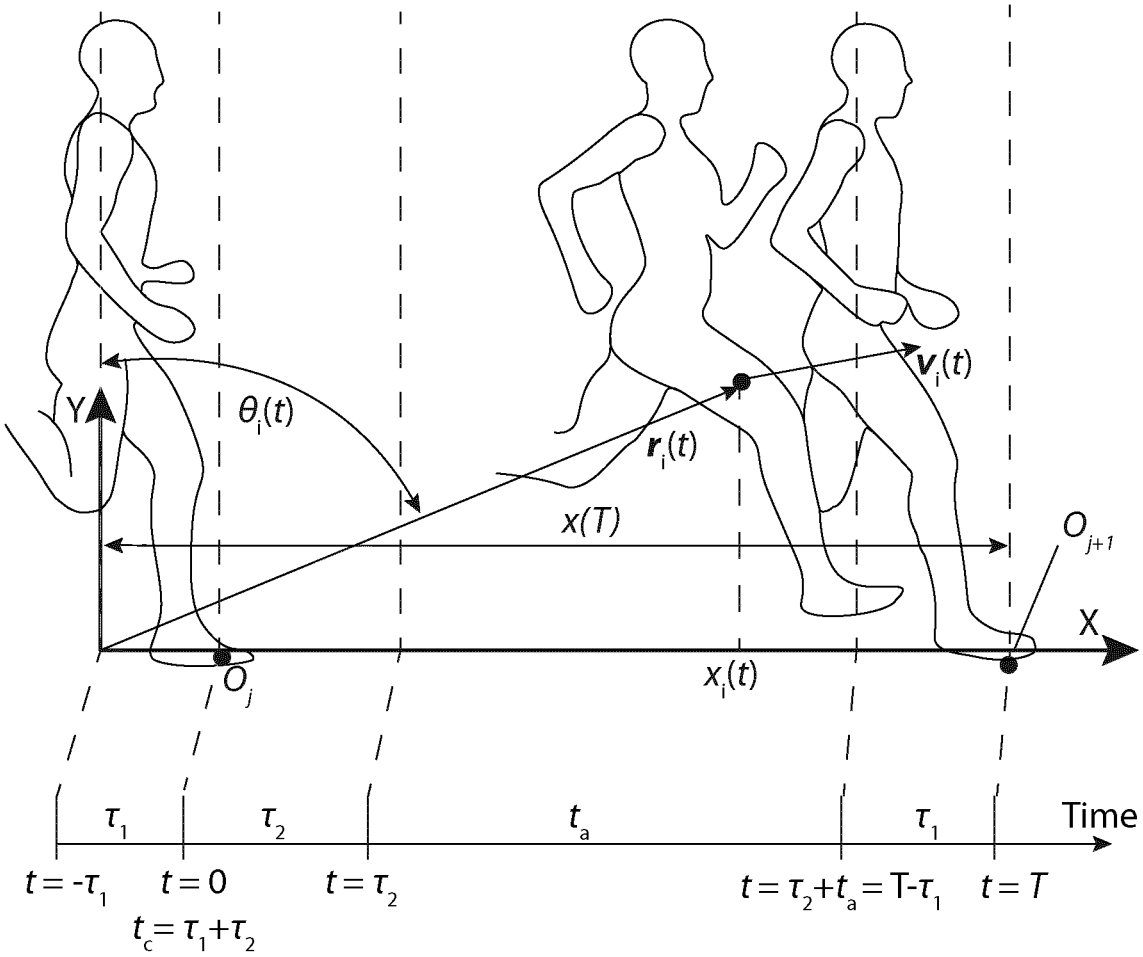
FIG. 2 are successive schematic views of a runner over a half-running cycle of duration T second; Kinematic variables defined from contact point $O_j$ to $O_{j+1}$, with center of mass of each body segment i at location $r_i(t)$ with a velocity vector $v_i(t)$. Contact time occurs during time period $t_c$ while flight (aerial) time period is $t_a$. Step duration is T, while $\tau_1$ is the time period required to stop vertical momentum of the runner at touchdown.
Figure 3:
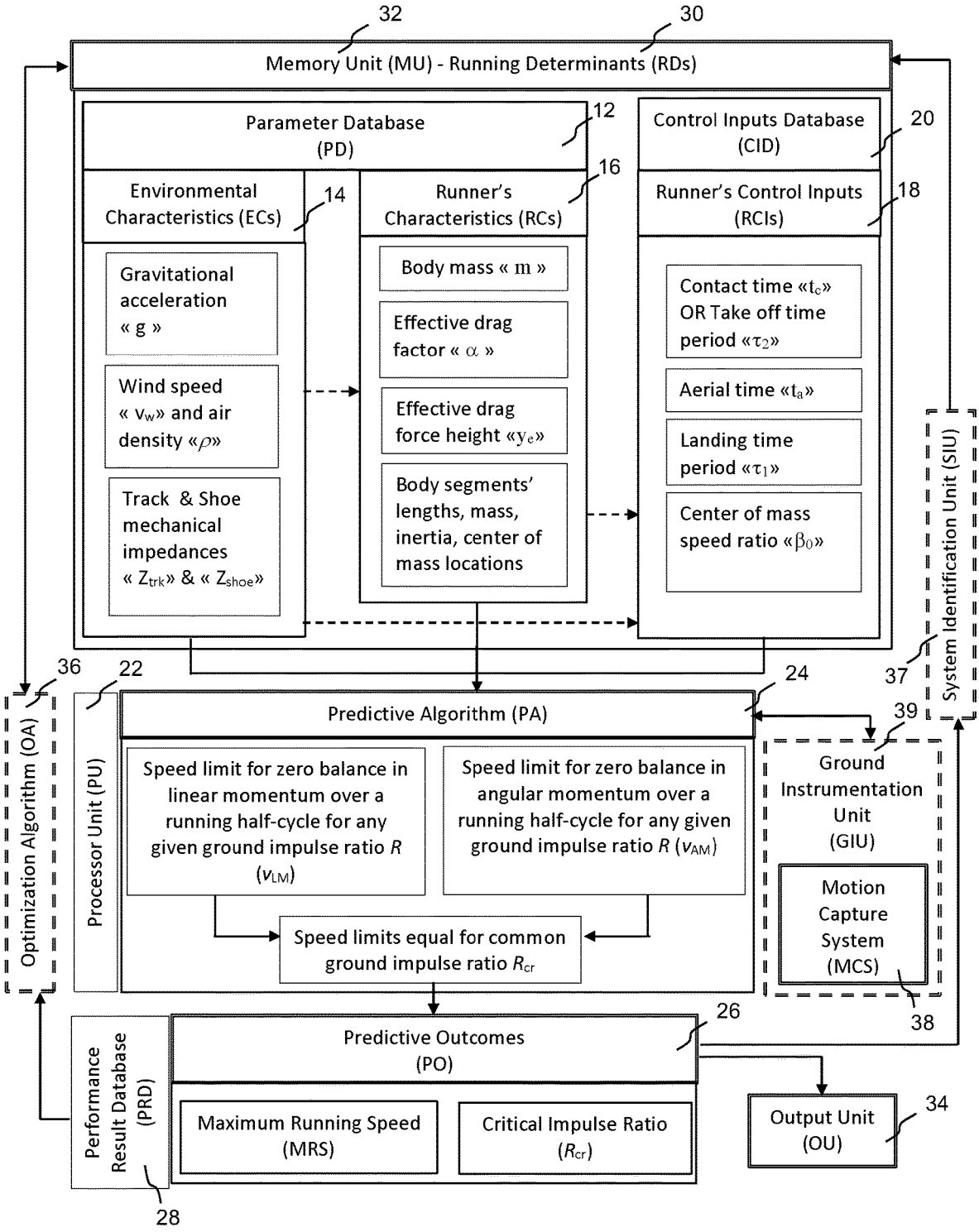
FIG. 3 is a schematic of the system composed of two complementary databases, a processor unit that supports the predictive algorithm and a database to store the predictive outcomes.

Referring mainly to FIG. 3, with relevant kinematics and kinetics variables defined in FIGS. 1 and 2, there is schematically represented a system 10 in accordance with an embodiment of the present invention that predicts the steady speed that a runner reaches based on given set of values for RDs 30. In fact, for a given set of RDs 30 values assumed to remain constant over time, a runner initially accelerates, but a steady speed will eventually be reached. That is why this steady speed is called a maximum running speed (MRS). In fact, during a given step at steady speed, the actual speed of the runner slightly increases during the ground foot impulse, but progressively decreases back to its original value during the aerial phase, up until landing occurs. Therefore, a runner never runs at a precise constant speed at all time. If a runner were to use the optimal set of RDs 30 values, and assuming that they can be physically and physiologically achieved by the runner, this MRS would be called a Maximal Running Speed (MaxRS). In other words, at any given race, a runner will achieve an MRS, yet this MRS will always be equal or lower than an ultimate value represented by the MaxRS value.

The system that predicts an MRS is composed of three sub-systems. The system first reads RDs 30 from a Parameter Database 12 (PD) that contains both environmental characteristics 14 (ECs) and runner's characteristics 16 (RCs) values that are assumed to be close to constant for a given running venue 102 and instant. ECs 14 include the gravitational acceleration g and the actual wind speed $v_w$ (both in amplitude and direction) that occurs at the time of the run, along with the air density ρ. For computational purposes, the wind speed is assumed positive when oriented in the direction of the runner's movement. ECs 14 may also include the running track and shoe mechanical impedances, respectively $Z_{trk}$ and $Z_{shoe}$, but these values are not directly involved in the computation of the runner's MRS prediction. In fact, they may influence the achievable range of Runners' Control Inputs 18 (RCIs) that form the Control Inputs Database 20 (CID).

Runner's characteristics 16 (RCs) include the runner's mass m and effective drag factor α. The drag factor is an effective drag factor because it allows for computing the drag force 40 that is exerted by the air on the runner 43, over typically a half-running cycle. This factor takes into account the runner's specific body segment movements and can as well consider the wind speed $v_w$ since the drag force is commonly defined based on the air velocity relative to the runner. Yet, preliminary investigations show that MRS predictions vary by only a few percent when comparing MRS values in no wind versus wind conditions below 2 m/s. In a different embodiment, the drag force 40 may be described not through the common drag factor that multiplies the square of the object velocity in the air, but a general nonlinear function hf(v) that relates drag force to the object velocity relative to the air. Such function could be obtained, for instance, through computational fluid dynamics (CFD) modelling, or experimentally in a wind tunnel for instance.

A half-running cycle (HRC) duration is defined by a runner that touches the ground surface 100 in two subsequent landings or, in other words, the duration of a single step. A running cycle duration is the time difference between two successive landings with the same foot or, in other words, the duration for two successive steps. The precision of an HRC is approximately within one tenth (1/10) of a contact time $t_c$ (see below), yet in practice it may need to be within 1 ms for faster runners whereas MRS values to be reached are critical.

The effective drag force height $y_e$ 42 is the vertical distance at which the resulting drag force 40 over a half-running cycle must be assumed to be exerted on the runner's body 43 to result in the total moment produced by the drag forces about the contact foot 44 over an HRC. This new variable has not been defined elsewhere in the literature. Wind speed $v_w$ again indirectly affects this parameter value which is defined in relation to the runner's actual speed. This height parameter takes into account the runner's specific body segment movements as well as the wind speed $v_w$. In a different embodiment, height $y_e$ could be defined from the use of a general nonlinear function hm(v) that relates the moment caused by the air on a runner, relative to the ground surface 100 at the foot contact point 44. Such function could be obtained, for instance, through CFD modelling, or experimentally, in a wind tunnel for instance.

RCs data 16 may also include anthropometry data (body segments 46, 72, 74, 76, 78 lengths, mass, inertia, center of mass locations), but these values are not directly involved in the computation of the runner's MRS prediction. In fact, they influence the achievable range of Runners' Control Inputs (RCIs) 18 described hereinbelow. For the sake of clarity, upper limbs 72, 74 include the arm, the forearm and the hand. Similarly, lower limbs 76, 78 include the thigh, the leg and the foot.

Given a set of ECs and RCs values, and a given venue 102, a runner has then the ability to control running speed by controlling a number of runner's control inputs, or RCIs, whose best estimated values are stored in a Control Input Database (CID) 20. These RCIs 18 include either contact time $t_c$ or take off time $\tau_2$, aerial time $t_a$, landing time $\tau_1$ and body center of mass 90 speed ratio $\beta_0$. Contact time is the time period during which a foot 44 is in contact with the ground surface 100. Take off time is the time period from when the body center of mass 90 has zero vertical velocity when in contact with the ground surface 100, to when the foot leaves the ground surface 100. Aerial time is the time spent in the air by the runner over a single step, whereas landing time $\tau_1$ is the time it takes for the body 43 to touch the ground surface 100 (or running track) and reach a point where the body center of mass 90 has zero vertical velocity. Control input $\beta_0$ is the ratio of the forward body center of mass 90 velocity over the trunk-head 46 forward velocity (assumed to be the MRS) at the moment at which the body 43 has reached zero vertical velocity following foot landing. That variable is affected in particular by how much acceleration is provided to both upper 72, 74 and lower 76, 78 limbs when the foot makes contact with the ground surface 100. This is one situation where the anthropometry plays a role in influencing RCIs 18, here by directly affecting the value of $\beta_0$ controlled by the runner.

In order to predict the MRS of a runner, the system, via a processor unit 22 (PU), then reads the gravitational acceleration value, the body mass value and the runner's aerodynamics parameters α and $y_e$, or more generally, the linear and moment aerodynamics nonlinear functions hf(v) and hm(v) that contribute respectively to the linear and angular impulses on a runner over an HRC. It also accesses the CID 20 to get a set of RCIs 18 values. The system then inputs those values into a congruency/predictive algorithm (PA) 24 that computes at least two predictive outcomes 26 (POs) that are sent to an output unit 34 (OU): the MRS achieved by the runner and the ground critical impulse ratio $R_{cr}$ required to maintain that speed. The processor unit 22 computes these POs 26 by establishing a congruency for the speed condition ($v_{LM}$) required to obtain a zero linear momentum balance of the runner over at least an HRC, for a given ground impulse ratio R value, with the speed condition ($v_{AM}$) required to obtain a zero angular momentum balance of the runner over at least an HRC, for the same R value and over the same HRC. The system further stores the POs 26 values in a separate Performance Result Database (PRD) 28 for post-performance analysis. The congruency algorithm **24*b* is preferably performed on at least a single HRC, but it can also be performed on more than one HRC time period. More HRCs makes it possible to improve the estimate for MRS or system identification of the RDs 30**.

Figure 4:
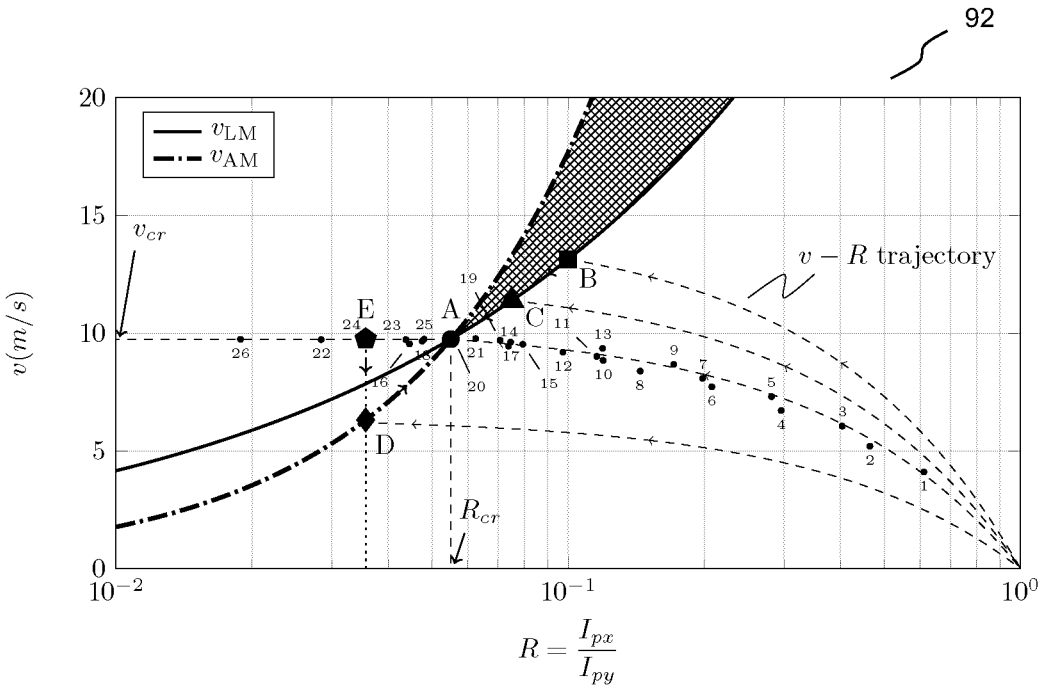
FIG. 4 is a graph illustrating physical speed curves constraints from a linear momentum perspective (solid line) and an angular momentum perspective (dash-dot line) for different values of ground impulse ratios R, using known RDs values for a given French runner. Dash line with associated black dots is the actual v-R trajectory plot achieved by the French runner at 9.75 m/s maximum speed. Black dots are actual field measurements of speed and ground impulse ratios of the runner. Numbers associated with the black dots represent the step number from the start of the run, in a field test on a track. Theoretical MRS is based on linear momentum (solid line) and angular momentum (dash-dot line) balance zeroing. Data digitized from R[24]. Runner's characteristic values considered from the computations are: $y_e$=3.84 m, $t_c$=0.099 s, $\tau_1$=0.027 s, $\alpha$=0,319, m=65 kg, H=1.74 m. Point A: critical point; Points B, C and D along with associated dash lines are hypothetical v-R trajectories assuming linear variation of ground impulse ratio R determined by Eq. 13. Point E is when a runner decides to slow down starting from point A.

In an embodiment of the present invention, the system can be used to provide MRS and $R_{cr}$ real-time feedback to the runner if data from the CID 20 are obtained in real-time from a ground instrumentation unit (GIU) 39 such as high speed cameras, or any appropriate motion capture system 38 with sufficient sampling capabilities such as wearable sensors (WSs) 104 affixed to the runner or the like. POs 26 time-varying values may be fed back to the runner through an output unit (OU) 34 such as an electronic display in various forms, via either a wired or a wireless communication network. In one embodiment, values are provided to the runner through a v-R linear-log map 92 as found in FIG. 4, plotted on the electronic display.

In a different embodiment, if either the $R_{cr}$ or the MRS values achieved by a runner are known, the system can use the same congruency/predictive algorithm (PA) 24 via the system identification unit (SIU) 37 to estimate any one missing value from the RCs 16 or RCIs 18 required data set, while other values are known.

With the present invention, if personal RCs 16 and RCIs 18 are unknown for a specific runner, those can be estimated, for instance, through a table look up approach, from the PRD 28 that stored POs 26 values as well as ECs 14, RCs 16 end RCIs 18 values for runners of a runner's representative population, those values having been accumulated previously.

The present invention also allows that mathematical optimization techniques may be used to figure out the best RCIs 18 value set for achieving a predetermined value of $R_{cr}$ or MRS value, using given values for ECs 14 and RCs 16. These optimizations that are occurring through the optimization algorithm (OA) 36 may rely on objective functions that consider, for instance, various constraints such as physiological limits of the runner, running economy, physical constraints such as range of shoe mechanical impedance, wind speed or track 100 mechanical impedance.

Similarly, the optimization techniques may be used to figure out the best ECs 14, RCs 16 and RCIs 18 values to achieve an ultimate MRS i.e. a MaxRS. In this context, not all RDs 20 may be modifiable and included in the optimization process 36. For instance, gravity 41 changes very slightly on the earth for a given running venue 102 and instant. Wind speed and air density that affect aerodynamics RCs 16 (e.g. $\alpha$ and $y_e$ or h(v) and hm(v)) may change, but are often considered fixed for short distance races. Track 100 mechanical impedance may certainly influence RCIs 18 chosen by a runner, but it is rather constant for a given running venue 102 and instant. However, shoe mechanical impedance can be easily changed on the short term before a race. Aerodynamics RCs 16 can also be changed on the short term before the race, through changes in clothing or hair configuration, or slight changes in both upper 72, 74 and lower 76, 78 limb movement trajectories during the running cycle. Body mass can be changed on the short term (e.g. water consumption, heavier clothing) or on a mid-term basis through weight gain or loss, yet anthropometry may be changed only on a mid-term basis, except for body segment lengths that are fixed. From the PU 22 theoretical perspective, RCIs 18 can take any value. Yet, there are range limitations that are dictated by physical and physiological constraints of a runner. These limits are most likely influenced by ECs 14 and RCs 16 such that they shall be considered when using optimization routines by the optimization algorithm 36.

Aerodynamic RCs 16 characteristics are dependent on two ECs 14: wind speed and air density. Notice that in one predictive algorithm (PA) 24 proposed, the effective aerodynamics RCs 16 ($\alpha$ and $y_e$) are defined using the absolute velocity v of the runner. Yet, aerodynamics principles teach us that the drag factor should be defined in terms of the air velocity relative to the body. Yet, preliminary calculations show that the MRS is only affected by a few percent when considering wind speed under 2 m/s.

In the principal embodiment of the present invention, the precise role of the PU 22 is to compute the performance outcomes 26 (POs) of the runner, typically the MRS and the associated ground critical impulse ratio $R_{cr}$. Both are obtained by figuring out the specific ground impulse ratio $R=R_{cr}$ which is such that both linear momentum and angular momentum balance (i.e. zero change in runner's momentum) are obtained for a given speed, over a HRC. When this condition is met, the runner has reached a steady running speed which is then considered a maximum running speed (MRS) for a given set of ECs 14 and RCs 16, along with specific RCIs 18 selected by the runner. By using the optimal RCIs 18 values when running, a runner can then achieve a MaxRS, for given ECs 14 and RCs 16 values.

The present invention also provides for a method for determining a maximum running speed (MRS) of a runner as a first predictive outcome 26 (PO). The method comprises the steps of:

- getting a plurality of running determinants 30 (RDs) of the runner and venue 102 stored in a memory unit 32 (MU);
- running a predictive algorithm 24 (PA) with a processor unit 22 (PU) connected to the memory unit 32 (MU) using the plurality of running determinants 30 (RDs) to typically determine both the maximum running speed and a critical ground impulse ratio ($R_{cr}$) (a second predictive outcome 26 (PO)) of the runner by zeroing, typically over at least a half-running cycle (HRC), both a linear momentum balance and an angular momentum balance of the runner; and
- providing the determined maximum running speed to an output unit 34 (OU) connected to the processor unit 22 (PU), and preferably storing the at least one of the first and second predictive outcomes 26 (PO) in a performance result database 28 (PRD).

Typically, the plurality of running determinants 30 (RDs) are stored in a parameter database 23 (PD) including environmental characteristics 14 (ECs) and runner's characteristics 16 (RCs) and a control inputs database 20 (CID) including runner's control inputs 18 (RCIs). Also, the environmental characteristics 14 (ECs) include a gravitational acceleration (g), a wind speed ($v_w$), an air density ($\rho$), and track ($Z_{trk}$) and shoe ($Z_{shoe}$) mechanical impedances. Similarly, the runner's characteristics 16 (RCs) include a body mass (m) of the runner, an effective drag factor ($\alpha$), an effective drag force height ($y_e$), and body segments' lengths, mass, inertia, and center of mass locations of the runner, and the runner's control inputs 18 (RCIs) include one of a contact time ($t_c$) value and a takeoff time period ($\tau_2$) value, an aerial time ($t_a$) value, a landing time period ($\tau_1$) value, and a center of mass speed ratio ($\beta_0$) value.

The method may further comprise the steps of:

- capturing motion data from the runner while running at constant speed using a ground instrumentation unit 39 (GIU) connected to the processor unit 22 (PU);
- determining real-time values of a portion of the plurality of running determinants 30 (RDs) with the captured motion data received from the processing unit 22 (PU), and providing therewith real-time values of the predictive outcomes 26 (PO).

Conveniently, the portion of the plurality of running determinants 30 (RDs) includes at least one of the effective drag factor ($\alpha$), the effective drag force height ($y_e$), one of the contact time ($t_c$) value and the takeoff time period ($\tau_2$) value, the aerial time ($t_a$) value, the landing time period ($\tau_1$) value, and the center of mass speed ratio ($\beta_0$) value, and the method may further comprise the step of:

estimating at least one of the plurality of running determinants 30 (RDs) using a system identification unit 37 (SIU) connected to the processor unit 22 (PU) to receive the predictive outcomes 26 (PO) therefrom, and sending the estimated one of the plurality of running determinants 30 (RDs) to the memory unit 32 (MU) connected to the system identification unit 37 (SIU).

In one embodiment, at least one of the plurality of running determinants 30 (RDs) is determined from a plurality of accumulated tabled values from other runners and stored in the performance result database 28 (PRD) in order to proceed via the table look up approach.

Typically, the method may also further comprise the step of:

determining optimized values of at least one of the plurality of running determinants 30 (RDs), using an optimization algorithm 36 (OA) connected to the performance result database 28 (PRD) to receive data therefrom, in order to improve the predictive outcomes 26 (PO), and sending the optimized values to the memory unit 32 (MU) connected to the optimization algorithm 36 (OA).

Conveniently, the method could further comprise the step of:

determining optimal values of the runner's control inputs 18 (RCIs) using the optimization algorithm 36 (OA) to achieve a predetermined value of at least one of the first (MRS) and second (R cr) predictive outcomes 26 (PO) using the environmental characteristics 14 (ECs) and runner's characteristics 16 (RCs).

Alternatively, the method may also comprise the step of determining optimal values of the environmental characteristics 14 (ECs), runner's characteristics 16 (RCs), and the runner's control inputs 18 (RCIs), using the optimization algorithm 36 (OA), to essentially achieve an ultimate predetermined value MaxRS of the MRS predictive outcome 26 (PO).

Mathematical Development of the Predictive Outcomes (PO)

Since energy is not conserved when running, the predictive algorithm 24 for obtaining the MRS is developed based on a conservation of linear and angular momentum principles of a runner over an HRC, encoded in the processor unit 22. FIGS. 1 and 2 define kinematics and kinetics variable necessary for developing these principles. Each conservation principle leads to a different expression for a runner's MRS. Conservation of linear momentum leads to a runner's velocity limit given by (Eq. S13):

$$v_{LM} = \sqrt{\frac{\mathrm{mg}}{\alpha}\frac{Ip_x}{Ip_y}} = \sqrt{\frac{\mathrm{mg}}{\alpha}R} \tag{1}$$

where m is the runner's mass, g is the gravitational acceleration, a is the drag factor (equivalent to coefficient k in R[27]) and R, the ground impulse ratio, is defined by:

$$R = \frac{Ip_x}{Ip_y} \tag{2}$$

i.e. the ratio of ground horizontal impulse over vertical impulse (Eq. S10). Notice that this ratio is slightly different from the ratio defined by R[27], but both are mathematically related. Hence, assuming that a runner produces a constant R value on the ground surface 100 at each step, the runner then starts to accelerate and progressively reaches a steady running speed $v_{LM}$.

At the same time, using the principle of conservation of angular momentum, one finds, instead, the following expression for a runner's velocity limit (Eq. S30):

$$v_{AM} = \frac{y_e}{\left[\frac{\beta_0 t_c}{2} + \frac{p_y}{\mathrm{mg}}(\beta_0 - 1) - \tau_1\right]}R \tag{3}$$

with parameter $\beta_0$ representing the ratio of runner's center of mass 90 horizontal velocity over the trunk-head 26 velocity at the beginning of the step cycle (Eq. S29), $\tau_1$ is the time period required to bring runner's vertical momentum to zero when landing, $\rho_y$ is that runner's vertical momentum at touchdown, and parameter $y_e$ 42 is the effective height of the aerodynamic forces' resultant above the ground surface 100 (Eq. S24). Here, it is assumed that the runner's center of mass 90 is located straight over the foot 44 contact point at t=0, i.e. $\bar{x}_0=0$, the optimal value to get a higher MRS. In terms of aerial time, Eq. (3) becomes:

$$v_{AM} = \frac{y_e}{\left[\frac{\beta_0 t_c}{2} + \frac{t_a}{\mathrm{mg}}(\beta_0 - 1) - \tau_1\right]}R \tag{4}$$

For $\beta_0=1$, the MRS relationship reduces to the following simple relationship:

$$v_{AM} = \frac{y_e}{\frac{t_c}{2} - \tau_1}R \tag{5}$$

which is independent of aerial time. This expression is compatible with commonly observed facts, but they were not necessarily considered causal: a higher MRS is achieved for a shorter contact time $t_c$ (R[22]; R[26]), a higher ground impulse ratio R (R[26]; R[32]) and a shorter time period $\tau_1$ (R[22]).

If a given impulse ratio R is performed by an athlete, then one can predict his/her MRS with either Eq. (1) or Eqs. (3 or 4). However, if one plots the MRS expressions originating from both conservation principles (FIG. 4), it can be observed, in general, that they do not lead to the same MRS value, except at point A, which is located at the intersection of the two curves. Point A is a critical point at which both conservation principles are met at the same time at steady running speed, whereas athlete's states are the same at every beginning of a step. Point A is defined by a critical impulse ratio $R_{cr}$ and a corresponding critical speed limit $v_{cr}$ that are obtained by setting both expressions for MRS equal, that is (Eq. S32):

$$v_{LM}=v_{AM} \tag{6}$$

Assuming that the runner's center of mass is over the foot contact point at t=0, then one can thus figure out the critical speed limit $v_{cr}$ of a runner as (Eq. S36)

$$v_{cr} = \frac{\mathrm{mg}}{y_e\alpha}\left[\frac{\beta_0 t_c}{2} + \frac{p_y}{\mathrm{mg}}(\beta_0 - 1) - \tau_1\right] = \frac{\mathrm{mg}}{y_e\alpha}C \tag{7a}$$

or, in terms of aerial time:

$$v_{cr} = \frac{mg}{y_e\alpha}\left[\frac{\beta_0 t_c}{2} + \frac{t_a}{mg}(\beta_0 - 1) - \tau_1\right] \tag{7b}$$

When $\beta_0=1$, the equation reduces to:

$$v_{cr} = \frac{mg}{y_e\alpha}\left(\frac{t_c}{2} - \tau_1\right) \tag{7c}$$

This critical velocity, defined as the runner's MRS, is achieved for a critical ground impulse ratio given by:

$$R_{cr} = \frac{mg}{y_e^2\alpha}\left[\frac{\beta_0 t_c}{2} + \frac{p_y}{mg}(\beta_0 - 1) - \tau_1\right]^2 = \frac{mg}{y_e^2\alpha}C^2 \tag{8a}$$

or, in terms of aerial time:

$$R_{cr} = \frac{mg}{y_e^2\alpha}\left[\frac{\beta_0 t_c}{2} + \frac{t_a}{mg}(\beta_0 - 1) - \tau_1\right]^2 \tag{8b}$$

which, for $\beta_0=1$, reduces to:

$$R_{cr} = \frac{mg}{y_e^2\alpha}\left(\frac{t_c}{2} - \tau_1\right)^2 \tag{8c}$$

Equation (7a) indicates athlete's MRS can be improved either by tuning ECs 14 and RCs 16 or by training the athlete to achieve better RCIs 18.

Improving Runners' MRS

By modulating RCs 16: In terms of parameter adjustments, clearly, increasing mass is beneficial and viable, as pointed out by R[8] who estimated that an optimal mass of 119 kg existed regarding maximal running speed. Reduction of the drag factor $\alpha$ is also a promising avenue through, for instance, improved clothing (R[15]), or modifications of ballistic limbs 72, 74, 78 (lower limb not in contact with the ground surface during the ground foot impulse) motion pattern through the running step time period. Yet, drag parameters are most likely correlated with anthropometry. In fact, using a human frontal area mathematic model developed by R[30], it is found that the critical velocity is given by $$v_{cr} = 15{,}9\frac{m^{0{,}575}g}{y_e H^{0/725}}C. \tag{9}$$

R[8], who studied MRS of various terrestrial mammals, found a much lower exponent for parameter m, indicating that parameter $y_e$ 42 and/or the C-value term are probably dependent on anthropometry.

Reduction of aerodynamic parameter $y_e$ 42 is certainly beneficial, but given the lack of knowledge regarding this parameter, it is difficult to determine if any significant gain can be made for a runner. Of course, from a nation perspective, selecting the athletes with the best RCs 16 and RCIs 18 is certainly to be considered in a team strategic plan.

Modulating any of the five RCIs 18: Once ECs 14 and RCs 16 parameters are set and a runner is capable of moving the limbs 72, 74, 76, 78 to get to a point where $\bar{x}_0=0$, the athlete is left with four control inputs to improve performance.

Controlling MRS with contact time $t_c$: Contact time is known to be a key indicator to performance (R[26]; R[32]). This is true if one looks at Eq. (5), but the balance in both linear and angular momentum is such that performance is, in the end, proportional to contact time. This striking difference with experimental observations is probably related to the fact that many studies reporting contact time were conducted on a treadmill that does not require the runner to deal with angular momentum, neither linear momentum of the trunk-head 46. Moreover, what is most important to MRS is the difference between contact time t, and time period $\tau_1$, which is itself included in contact time period. In order to clarify this issue, high speed videos of national athletes running on a track 100 were collected to estimate RCIs 18 kinematic variables. Results are listed in Tables S1, S2 and S3. Contact time estimates vary between 86 ms to 100 ms for all three runners, but they could be slightly higher depending on how contact time is defined in practice.

From a purely geometric standpoint, contact time must be shorter at higher speed, if we assume identical kinematics of the stance limb as a function of speed. Yet, since the lower limb is a redundant mechanism, athletes thus have some ability to vary contact time, probably by a few msec, through variations of the stance limb configuration during the contact time period. In addition, one must also consider the contribution of upper limbs 72, 74 and the swing leg 78 (in fact, either 76 or 78 depending on which foot is in contact with the ground surface 100) which, by transferring vertical momentum to the trunk-head 46, can influence when takeoff occurs.

Controlling MRS with time period $\tau_1$: Eq. (7) shows that time period $\tau_1$ can have a significant impact on MRS. That time period is defined as the time period required to bring the runner's body 43 vertical motion to zero at touchdown. As one can observe from videos, when the athlete trunk centroid passes over the contact foot, there is indeed a point where all body segments appear to be moving horizontally. That period varies from 25 to 33 ms for the three athletes that were investigated. Ideally, one would like to eliminate that time period to maximize running speed. However, physics makes this goal impossible because it takes time to reduce vertical momentum to zero, given that lower limb mechanical impedance is not infinite (R[23]). However, increasing lower limb mechanical impedance would certainly help reduce $\tau_1$, though requiring the runner to lower the swing limb faster at the end of the aerial time period.

Controlling MRS with aerial time to or vertical momentum $\rho_y$ at takeoff Aerial time/Vertical momentum at takeoff play an interesting role on MRS. Indeed, if parameter $\beta_0$ is larger than 1, then it is beneficial to have larger aerial time. Otherwise, it is better to reduce it as much as needed to bring the ballistic leg 78 forward to prepare for the next step. There could be confusing data in the literature (e.g. R[32]) because many studies were conducted on treadmills 106. Moreover, aerial time estimation suffers from the same precision problems as those for estimating contact time from videos. The three athletes whose runs were recorded had a flight time of about 160 ms. Hence, the vertical momentum at takeoff for the female runner can be easily estimated from aerial time (Eq. S25), assuming that ballistic limbs motion is symmetrical between two successive steps. It is found to be in the order of 50 kg-m/s. Based on the terms within the brackets in Eq. (7), such vertical momentum then contributes very little to critical velocity (assuming $\beta_0$ is not significantly larger than 1), compared to contact time $t_c$ and time period $\tau_1$. Its estimation is therefore less critical than contact time or time period $\tau_1$. Therefore, as a first approximation, MRS expression could be reduced to:

$$v_{cr} = \frac{mg}{y_e^2\alpha}\left(\frac{\beta_0 t_c}{2} - \tau_1\right) \tag{10}$$

Controlling MRS with variable $\beta_0$: This is by far the most interesting control variable of Eq. (7) because it directly affects contact time and its value determines if aerial time helps or impedes running speed. Variable $\beta_0$ is best understood by noticing that at t=0, both upper limbs 72, 74 are crossing the trunk frontal plane, as well as the swing limb 78 (in fact either 76 or 78 depending of which foot makes contact with the ground surface 100). At this point, from a kinematics standpoint, one could state that upper limbs 72, 74 together have the same velocity as the trunk, since they are in opposite horizontal motion. However, the ballistic lower limb 78 (either 76 or 78) center of mass moves forward at a speed higher than the trunk-head 46 velocity, while the stance limb 76 center of mass has a lower speed. Therefore, at t=0, the body center of mass 90 forward velocity $\bar{v}_0$ is most likely different from the trunk-head 46 velocity v since, for a system of interconnected bodies of mass m:

$$\bar{v} = \frac{\Sigma\, m_i\, v_i}{m} \tag{11}$$

On can thus define variable it such that at t=0:

$$\beta\,|_{t=0} = \frac{\bar{v}}{v}\,|_{t=0} = \beta_0 = \frac{\bar{v}_0}{v_0} = \frac{\bar{v}_0}{v} \tag{12}$$

the ratio of runner's body center of mass 90 forward velocity over the trunk-head 46 velocity at t=0. All three ballistic limbs 72, 74, 78 (or 76 at the next step) can contribute to increasing variable $\beta_0$ which, in turns, increases MRS.

Predicting Athletes' Running Performance

Although the mathematical model developed here is exact, there might be other considerations that were not included in analyzing what could affect athlete's MRS. Several validations were thus performed with field data that show that the MRS model developed can accurately predict the kinetics and kinematics of elite 100-m runners within a few percent.

Firstly, using Eq. (1), the ground impulse ratio R of an athlete investigated by R[27] can be computed, assuming a steady running speed of 9.75 m/s. A corresponding impulse ratio of 5.5% is found, equal or less than 1% from the actual value measured at maximum running speed. Moreover, using Eq. (7), athlete's anthropometry and parameter $y_e$=3.3 estimated from the female runner investigated in the videos (who has similar anthropometric parameters) and assuming a time period $\tau_1$ of 0.028 s, the athlete MRS was found to be 11.2 m/s, in the range of values stated for the runner (R[27]). Such time period $\tau_1$ is physically possible, as it was measured as low as 0.025 s in the video of male athlete A.

Figure 5A:
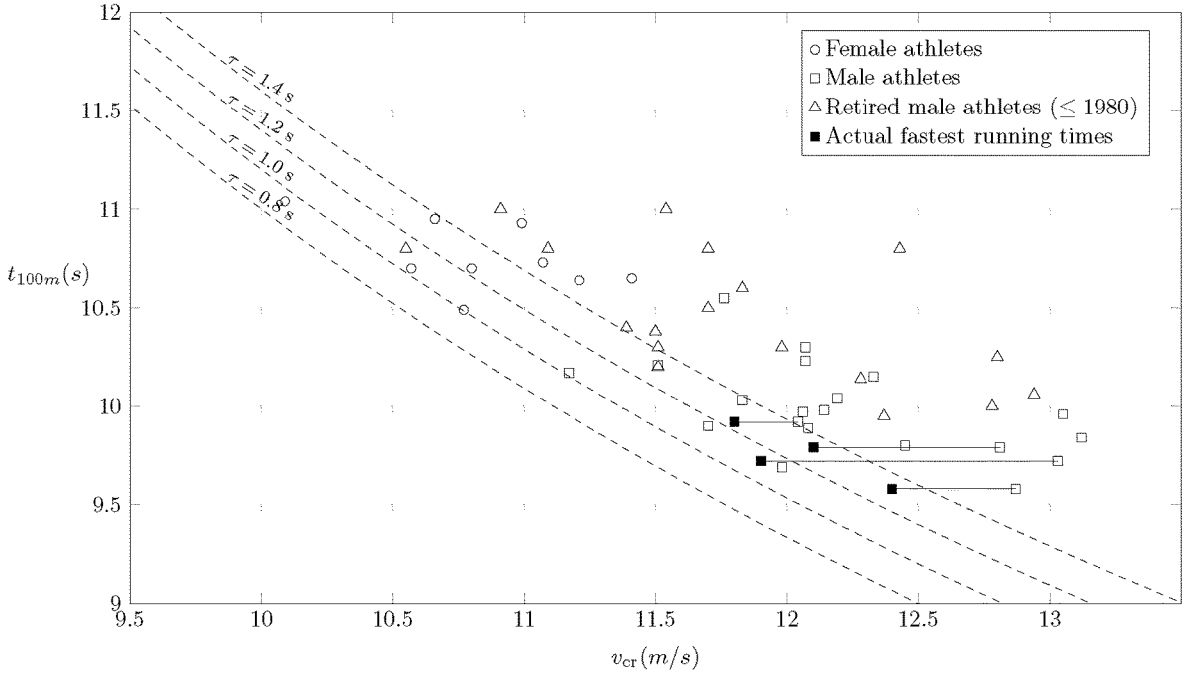
FIG. 5*a* is a graph illustrating actual 100-m race times for various athletes listed in Table S4, as a function of their predicted $v_{cr}$, or MRS. Female (empty circles); Men (empty squares); athlete's results before 1980 (empty triangles); actual maximum running speed reached by four (4) different athletes (black squares connected to empty squares by horizontal lines). Predictions are made by assuming drag factors computed for each athlete from the work of R[27] and published anthropometry data obtained from the web.

Secondly, using realistic values for the four control parameters (RCIs 18) (and assuming that $\bar{x}_0$=0), predicted MRS values for a number of elite athletes are conducted and correlated with their MRS and their recorded personnel best running times at the 100-m race using Eq. S39 (Table S4 and FIG. 5*a*). Data show that women (empty circles) have lower performance than men (empty squares), and that athletes that were active before 1980 (empty triangles) have equal or lower performance than current male runners. Actual MRS data were measured by other investigators for four different athletes (R[4]) and they are illustrated as solid black squares data points. The black squares are connected to the corresponding athlete empty square data points by horizontal lines. As shown, there is a non negligeable difference between predicted maximal speed (MRS) and actual maximum speed, in the order of 0.5 m/s. This difference could be related to the prior assumption of constant RCIs 18 across runners.

Figure 5B:
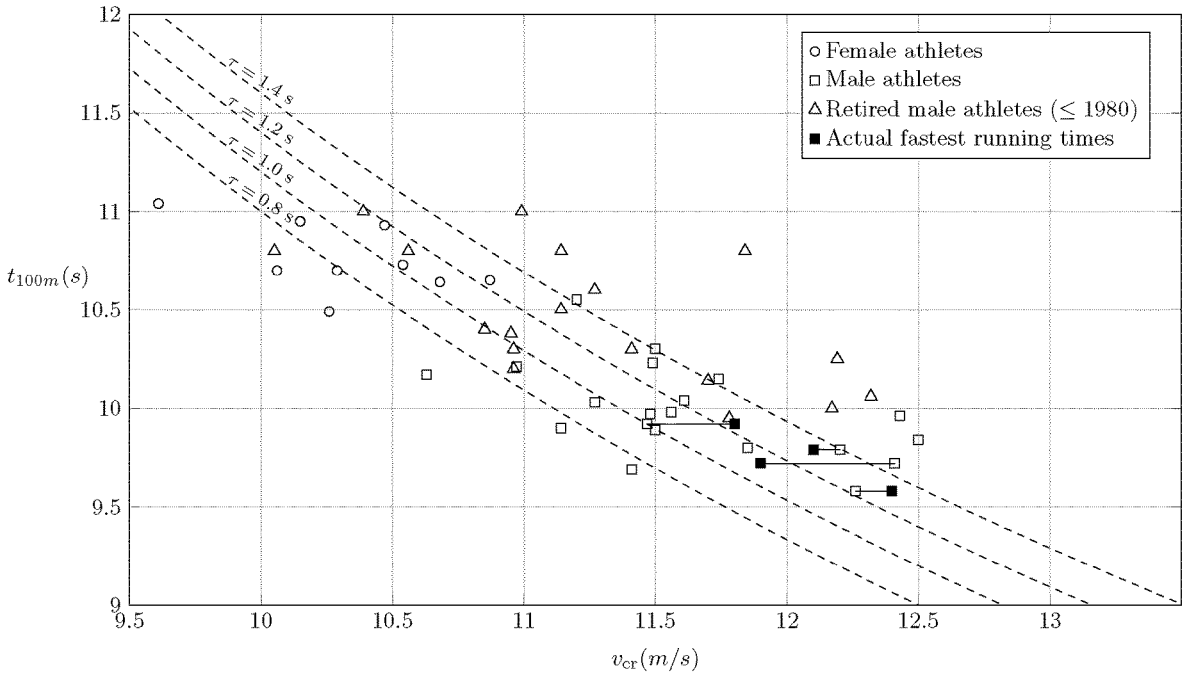
FIG. 5*b* is a graph similar to FIG. 5*a*, assuming a 2% increase in the drag factor.

Thirdly, Eq. S39 is plotted for different values of time constant r in FIG. 5*a*. In practice, athletes' MRS should lie within the region bounded by the dash lines obtained by assuming time constants $\tau$=0.8 and $\tau$=1.2 (acceleration data published by R[27] indicated a time constant of about 1.2). Predictions for MRSs should follow the trend expected from the exponential velocity profile model of Eq. S39, but there are definitely differences between actual MRS and predicted MRS. A better fit for Eq. S39 is obtained if the drag factor is increased by only 5% for computing the MRS predictions. Such small change is enough to almost overlap actual and predicted MRS for Usain Bolt ($t_{100}$=9.58 s) and to bring the cloud of points closer to the mathematical model of Eq. S39, as shown in FIG. 5*b*. Consideration of wind speed may also explain some of the discrepancies, as wind speed can change the effective drag factor.

As a final validation step of the model developed, the actual ground impulses of the French runner measured by force platforms by R[27] were plotted in the v-R plot (FIG. 4). As one can observe, the trajectory curve followed by the runner in the v-R plane brings him at about the interaction point A of the $v_{LM}$ and $v_{AM}$ curves. Since maximum running speed of the athlete (9.75 m/s) was used to compute the $v_{LM}$ and $v_{AM}$ curves intersection point A, it is not surprising that the experimental data points end up at the same speed level at point A. However, what is surprising here is the fact that the impulse ratio R at maximum speed is very close to the ratio $R_{cr}$, as computed earlier. More importantly, though, the impulse ratio R appears to oscillate about $R_{cr}$ for the latest steps as one may expect because it is unlikely that an athlete can perfectly set $R_{cr}$ to the same value at every step. Therefore, the runner constantly tries to adjust his impulse ratio to accommodate the zeroing balance in momentum, from one step to another.

Interestingly, the dashed curve that ends up at point A represents a theoretical acceleration of a runner, assuming a linear fit between runner's speed versus impulse ratio R, from the starting line to the critical point A. As shown, there is a very good fit with experimental data. Actually, the equation for the that specific dash line is:

$$v(t) = \frac{v_{cr}}{1 - R_{cr}}R(t) + \frac{v_{cr}}{1 - R_{cr}} = \frac{v_{cr}}{1 - R_{cr}}(1 - R(t)) \tag{13}$$

which is a straight line in a linear space with R.

Although MRS predictions seem compatible with published performance data, it remains that exact predictions will only be possible when drag related parameters (or drag functions hf(v) and hm(v) and the RCIs 18 and their possible range of variations are known for each athlete, with sufficient precision. Drag parameters can eventually be obtained from advanced CFD studies or experimental measurements. Drag factor $\alpha$ has attracted much interest for many years, but it has never been evaluated in true running conditions. The situation is even more problematic as parameter $y_e$ 42 has probably not been explicitly studied in the past. Data from the French runner can be used to estimate drag factor $\alpha$, using Eq. 1. A value of 0.369 is found, in the range of what is obtained using Eq. S38. As far as parameter $y_e$ 42 is concerned, kinematics data from the three athletes investigated were used to estimate it since one needs a good estimate of control input $\tau_1$.

Interpreting the v-R Curves

Physical or physiological limitations are often suggested as a root cause for running speed limitation (R[9]), but as Haugen pointed out, physical constraints should also be considered. In this specification, the applicant shows that such a physical constraint does exist, through conservation of linear and angular momentum over a step cycle. In FIG. 4, the intercept critical point A of the two theoretical curves is a point where ground impulse ratio and runner's speed are such that there is a balance in both linear and angular momentum. If a runner chooses to follow a velocity-impulse ratio (v-R) trajectory that brings him/her to point B located on the $v_{LM}$ curve, and further decides to maintain the same ground impulse ratio, the runner would be incapable to increase forward speed due to aerodynamic forces but, at the same time, oddly, would keep producing excessive angular momentum at every step. This is clearly a problem for the stability of the runner because given that forward speed cannot be increased any further, and because the runner is at his/her maximum upright position, any increase in angular momentum must be stored through either increased movements of the limbs 72, 74, 78 (or 76 at the next step) (upper limbs and swing leg) or trunk-head 46 vertical downward velocity or rotational velocity, which is not desired to avoid forward fall of the runner on the ground surface 100. Alternatively, the runner could increase the vertical impulse at touchdown to cancel out the increase in angular momentum that occurred during the step time period. This would lead to a higher flight trajectory during the next step and, therefore, reduction in forward velocity. Hence, this is a marginally stable intercept line that a runner cannot cross over too extensively. If a runner v-R trajectory ends up at point C instead, this marginally stable problem is still present, but the runner can quickly descend the solid curve down to point A, where compatibility exists in the linear and angular momentum balance at every step. At this point A, if a runner wants to slow down, he or she will be momentarily moving to point E, where aerodynamic forces progressively decrease both linear momentum and angular momentum until a new point A is reached, modulating parameters of the critical velocity equation.

But, what happens if the runner chooses to follow a v-R trajectory that brings him/her to point D? If the runner still maintains the same ground impulse ratio, the runner's body 43 is no longer capable of increasing angular momentum, but he/she has the ability to increase forward velocity. This is a situation that requires a refined time varying analysis of the v-R curves to figure out how a runner manages this paradoxical dynamic situation. In fact, runners most probably change their running parameters to change point A location and to bring it down to a lower velocity, by a change of any of the RCIs 18.

How Humans Run a 100-m from a Momentum Perspective

For a number of years (R[32]; R[19]), it has been known that the bottom line to improve MRS is to increase the horizontal foot impulse that an athlete can generate, particularly at high speed. Runners might not have the opportunity of increasing this horizontal impulse at will because they also have to manage the angular momentum generated by gravity 41 during a step cycle. The higher runner's speed is, the more difficult it becomes to counteract the action of gravity 41, both in the vertical direction (R[33]) as well as in terms of angular momentum. Therefore, running speed would actually be limited by the inability of a runner to store/eliminate the additional angular momentum created by an increase in speed, without falling over or eliminating the increase in velocity that the prior foot impulse provided.

Athletes face this problem all through the 100-m race. Over the first few steps of a 100-m, athletes are tilted forward, thereby allowing gravity 41 to produce large increase in angular momentum at every step, which must be stored into the runner before initiating the next step. At the starting blocks, as soon as the athlete takes his hands off the ground, gravity 41 starts to produce angular momentum about the contact foot 44. Since the runner's center of mass 90 has no velocity at this point and it takes time to build up linear momentum, then the runner chooses to store the angular momentum by first moving the swing limb forward 78 (or 76 at the next step), to further extend the stance limb to provide forward velocity to the body center of mass 90. If the runner had not done so, angular momentum would have been stored as angular velocity or downward velocity of the runner's trunk, eventually leading to a forward fall. Progressive elevation of the runner is therefore required at each step in the acceleration phase in order to store the angular momentum generated during each step cycle.

During a step cycle, when the runner is at his/her most upright position, the angular momentum produced by gravity 41 must be stored in the runner by initially raising the ballistic limbs progressively, by increasing their forward velocity and finally, by raising the runner's center of mass 90 during the aerial time phase. At the same time, aerodynamic forces partially eliminate some of the angular momentum produced, and any remaining excess to balance out angular momentum over the step cycle must be eliminated by the vertical impulse at touchdown.

Interestingly, the horizontal foot impulse that the stand limb 76 can produce through limb extension at the end of the contact time period does not directly contribute to angular momentum. Hence, it is desirable to execute the extension as late as possible while making contact with the ground surface in order to obtain as much forward impulse as possible, without affecting angular momentum. Video data of runners show that extension does occur in the last msec or so of the contact time period, well below the time required to fully contract a muscle (R[14]). A late extension is of course detrimental to the production of a vertical impulse required for the aerial time during which the ballistic limb 78 is moved forward after taking off. That is one place where ballistic limbs 78 can significantly contribute to running. Their momentum, built up during more than the aerial time period of about 160 ms, can be transferred to the head/trunk/pelvis complex 46, to help elevate the runner's body, even after takeoff has occurred.

This is what has been observed in videos of three runners that were investigated. For instance, video data from a female runner shows that the total vertical motion trajectory of the right hand (hand from right upper limb 7474), from the waist (at t=0) to its maximum height, occurs within 90 msec. If it is assumed that right upper limb 74 deceleration starts at mid-trajectory, one can see that momentum transfer from the right upper limb 74 to the trunk-head 46 initiates about 13 ms before the contact foot 44 leaves the ground surface 100. During the 90 msec trajectory, the right hand also appears to start from rest and to accelerate forward to reach a speed higher than the trunk-head 46, as does the lower swing limb 78. This action gives the athlete a mean to transfer both vertical and horizontal momentum to the trunk-head 46 during the step period. In fact, all three limbs 72, 74, 78 appear to move in synergy, thereby indicating their synchronous role in providing vertical impulse for takeoff, and potentially horizontal impulse as well, at least from the swing lower limb 78.

More advanced studies are necessary to quantify the role of ballistic limb 72, 74, 76, 78 movements on running performance. The contribution of ballistic limbs to running was considered early through investigations by Marey, using 60 Hz chronophotography (R[20]) and a novel force platform (R[21]), or the meticulous energy and momentum work of R[6] & R[7], based on 120 Hz films. The latter found that ballistic limbs could provide as much as 50% of the runner's vertical momentum. Although their work provided valuable insights on ballistic limb contribution to running, their exact role was still to be clarified. As a matter of fact, aside from preventing rotation of the runner's body about a vertical axis when the swing limb is accelerated horizontally relative to the trunk during the recovery phase (R[12]), it is clear that ballistic limbs control the value of variable $\beta_0$, and they can contribute to vertical and horizontal linear momentum as well as angular momentum production and storage. Past research on the subject has been equivocal on these multiple running functions of the ballistic limbs because many studies were actually conducted on a treadmill 106 that compels the runner to keep trunk forward momentum at zero, with no wind resistance to counteract and essentially no angular momentum to be managed or produced by gravity.

Although physics plays a significant role in running, strong physical and motor control training is also required to perform well in running. As shown in Eq. 10, timing of limb trajectories, close to a few milliseconds, is critical to correctly manage both linear and angular momentum of the runner, particularly at touchdown. Touchdown is by itself a very demanding task for the body because the runner's 50 kg-m/s vertical momentum must be reduced to zero within about 23 msec (data from a female runner), a time period much shorter than the 100 msec required to activate a skeletal muscle (R[14]). The high average foot vertical force involved (2855 N=4.5×body weight for the female runner) is so large that passive eccentric action of the lower limb 76 is probably required to produce that force level in such a short time period over several cycles. This issue was noticed by R[22] who suggested that lower limb stiffness might be responsible for creating such a high vertical force at touchdown. It is known that limbs have significant output mechanical impedance (R[13]; R[20]), in particular, at the ankle joint during walking (R[17]) and this property can be used to perform the touchdown action in 23 msec, by co-activating ankle joint muscles prior to landing, as seen from the video of the female runner investigated. Finally, the task of bringing the recovery limb 78 forward after takeoff up to a point where $\bar{x}_0=0$ at t=0, clearly requires precise motor control learning and physical training.

Further Details on the Mathematical Development of the PO

In a 100-m race, a runner starts with zero linear momentum p, and zero angular momentum $H_O$ about an arbitrary point O. For convenience, and without loss of generality, point O is taken as a point located at the ground at the starting line. Over the course of more than 41 steps (R[4]), athletes must gain both linear momentum and angular momentum resulting from the action of external forces, namely gravity 41 (*mg*), aerodynamic forces f 40, and foot ground forces $F_{cx}$ 45 and $F_{cy}$ 47 (FIG. 1). A runner develops linear momentum p by producing a positive horizontal ground impulse $I\rho_x$ and a positive vertical ground impulse $I\rho_y$ at every step over the first 50 m or so (R[16]) during a foot contact time $t_c$. Impulses are expressed as:

$$Ip_x=\int_0^{t_c}F_{cx}dt \tag{S1}$$

$$Ip_y=\int_0^{t_c}F_{cy}dt \tag{S2}$$

Linear momentum is stored in the runner's body segments, modeled as a system of interconnected bodies, whereas (R[34]):

$$p=\sum_i^N m_i\bar{v}_i \tag{S3}$$

where $\bar{v}_i$ is the velocity vector of the center of mass of segment i, with its corresponding mass $m_i$. In other words, over about the first half of a 100-m race, athletes increase and store linear momentum by acquiring forward velocity for each of the N body segments of the runner.

If the arbitrary reference point O is taken as at any contact point $O_j$ during the 100-m race (FIG. 2), angular momentum of the runner in a sagittal plane is defined by:

$$H_O=\sum_i^N \bar{I}_i w_i+\sum_i^N \bar{r}_{i/O}\times m_i\bar{v}_i \tag{S4}$$

with $\bar{I}_i$, the inertia of body segment i about its center of mass, $\bar{r}_{i/O}$ is the position vector of the center of mass of segment i relative to point O. In other words, a runner can store angular momentum in two ways: by allowing body segments to acquire angular velocity $\omega_i$ (albeit, a non-desired situation for the trunk-head 46 segments), or by changing body segments center of mass velocities/orientation or their position vector $\bar{r}_{i/O}$. One safe and quick way to achieve that is by simply raising the center of mass of body segments that possess forward movement, such as raising the whole runner's body 43 upward, or raising the swing leg 78 or upper limbs 72, 74 during the step cycle.

From a macroscopic standpoint, running is a motor task where two different momentum principles must be addressed at the same time. For the purpose of illustrating this physical constraint to running, and without loss of generality, let's focus on a step cycle over a time period T defined as:

$$T=t_c+t_a \tag{S5}$$

with $t_a$ being the time duration of the aerial phase or flight phase between two successive steps from contact points $O_j$ to $O_{j+1}$.

Let's assume that the runner has reached a steady running speed at contact point $O_j$, such that the body initial states, when the foot makes contact at point $O_j$ are the same as those when the contralateral foot lands at next contact point $O_{j+1}$, assuming symmetry in the limb movements.

Let's define $p_y$ as the vertical momentum produced by the foot ground vertical reaction force for taking off, starting from a zero vertical runner's momentum. Since vertical takeoff momentum reduces down to zero by the effect of gravity, half-way during the aerial phase time period and, thereafter, since gravity produces an approximately equivalent downward momentum in the second half aerial period prior to landing, then the total vertical ground impulse $Ip_y$ produced during contact time $t_c$ is rather expressed as:

$$\int_{-\tau_1}^{\tau_2} F_{cy}dt = Ip_y = 2p_y + mg(\tau_1+\tau_2) \quad \text{(S6)}$$

where contact time is now defined as:

$$t_c = \tau_1 + \tau_2 \quad \text{(S7)}$$

Variable $\tau_1$ is defined as the time period required to eliminate runner's vertical momentum $p_y$ during landing, and $\tau_2$ is the time period remaining to complete contact time period, for providing the vertical momentum $p_y$ required for takeoff.

At steady speed, running is constrained on the one hand, by conservation of linear momentum along both the X and Y axis. Along the vertical axis Y, this principle is expressed as:

$$\int_{-\tau_1}^{\tau_2} F_{cy}(t)dt - mgT = 0 \quad \text{(S8)}$$

and along the horizontal axis X, it is expressed as:

$$\int_{-\tau_1}^{\tau_2} F_{cx}(t)dt - \int_0^T f_x(t)dt = \sum_i m_i \; v_{ix}(t)\Big|_0^T = 0 \quad \text{(S9)}$$

if it is assumed that the runner maintains the same running pattern at every step and that vertical aerodynamics resistance is negligeable.

Let's define a ratio R of the ground force impulse components at approximatively constant velocity as:

$$R = \frac{\int_{-\tau_1}^{\tau_2} F_{cx}(t)dt}{\int_{-\tau_1}^{\tau_2} F_{cy}(t)dt} = \frac{Ip_x}{Ip_y} = \frac{f(v)}{\text{mg}} \quad \text{(S10)}$$

assuming that the air resistance force over a complete step cycle is defined as:

$$f(v) = \frac{1}{T}\int_0^T f_x(t)dt \quad \text{(S11)}$$

Let's assume that the air resistance is modeled as:

$$f(v) = \alpha v^2 \quad \text{(S12)}$$

with $\alpha$, the drag factor. Hence, the maximum velocity of a runner is reached when the ratio of foot components impulses is maximum, that is:

$$v_{max} = v_{LM} = \sqrt{\frac{\text{mg}}{\alpha}\left(\frac{Ip_x}{Ip_y}\right)_{max}} = \sqrt{\frac{\text{mg}}{\alpha}R_{max}} \quad \text{(S13)}$$

without any assumption here on what physical, physiological or motor control factors actually limit maximum impulse ratio $R_{max}$.

Since a runner can be modeled as a system of interconnected body segments, running is also constrained by the angular momentum conservation principle about any arbitrary point in space. It is instructive to apply this principle about the contact point $O_j$.

To elaborate the conservation of angular momentum principle for a step at point $O_j$, to a next step at point $O_{j+1}$, one must take into account the contributions of the drag 40 and gravitational 41 forces as well as the fact that there is an angular momentum $H_{Oj}=H_O$ at t=0, and an angular momentum $H_{Oj+1}=H_{Oj}=H_O$ at t=T, which are assumed to be identical since the runner is moving at about constant speed. Hence, at steady running speed condition, the angular impulse balance over a complete step cycle is zero, which, when neglecting vertical components of aerodynamic forces, leads to:

$$\int_0^T \sum_i m_i \; gr_i \; \sin\theta_i(t)dt - \int_0^T f_x(t)y(t)dt - \int_{T-\tau_1}^T F_{cy}x(T)dt = 0 \quad \text{(S14)}$$

whereas y(t) is the vertical distance at which the resulting aerodynamic force 40 must be exerted on the runner to produce the actual moment created by the aerodynamic resistance on the runner about the ground surface 100. It is worth noticing that neither the ground force at point $O_j$ nor the horizontal ground force at point $O_{j+1}$ contribute to the moment impulse balance.

Keeping in mind that (FIG. 2):

$$r_i(t)\sin\theta_i(t) = x_i(t) \quad \text{(S15)}$$

one thus has:

$$\int_0^T \sum_i m_i \; gr_i \; \sin\theta_i(t)\; dt \quad \text{(S16)}$$

$$= \int_0^T \sum_i m_i \; gx_i(t)dt \quad \text{(S17)}$$

$$= \int_0^T mg\bar{x}(t)dt \quad \text{(S18)}$$

$$= mg\left[\bar{x}_0 T + \frac{\bar{v}_0 T^2}{2} + \int_0^T\int_0^t\int \bar{a}dtdtdt\right] \quad \text{(S19)}$$

where $\bar{a}$ is the runner's center of mass 90 acceleration. This acceleration can be obtained by Newton's law on a system of interconnected bodies given by:

$$\Sigma F_{cx} = m\bar{a} = (m-m_L)a + m_L\overline{a_L} \quad \text{(S20)}$$

where m and $m_L$ are respectively the mass of the runner and the limb segments together, and a and $\overline{a_L}$ are the respective accelerations of the head/trunk/pelvis complex 46 and the limb segments 72, 74, 76, 78 together.

Now, since at steady running speed over a complete step cycle, the external forces on the runner cancel out over a step cycle, the triple integral of Eq. S20 vanishes. Therefore, if the above angular momentum conservation principle is considered, one ends up with:

$$mg\left(\overline{x_0}T + \overline{v_0}\frac{T^2}{2}\right) - (p_y + mg\tau_1)x(T) = \int_0^T f(v)y(t)dt \simeq f(v)y_e \rightarrow \frac{f(v)}{mg} = R = \frac{1}{y_e}\left[\overline{x_0} + \frac{1}{2}\overline{v_0}(t_c+t_a) - \left(\frac{t_a}{2}+\tau_1\right)\frac{x(T)}{T}\right] \quad \text{(S21)}$$

Notice that, as defined in Eq. S6, the vertical ground impulse $Ip_y$ includes the effect of gravity, while the actual momentum $p_y$ is defined as the resultant vertical initial or final momentum of the runner during contact time period. Thus, assuming that:

$$p_y = \frac{1}{2}(Ip_y - mgt_c) \tag{S22}$$

$$\int_{T-T_1}^{T} F_{cy}x(T)dt = (p_y + mg\tau_1)x(T) \tag{S23}$$

and, also, assuming (admittedly unwary) the following approximation that:

$$\int_0^T f_x(t)y(t)dt \simeq f(v)y_cT \tag{S24}$$

where $y_c$ is the effective height of the horizontal component of the air resistance over a complete step cycle. The next step is to determine x(T), the stride length. As a general rule, one can use the kinematic equations along the X and Y axis to find the stride length, that is:

$$\Delta y = 0 = v_{0y}t_a - \frac{gt_a^2}{2} \rightarrow t_a = \frac{2p_y}{mg} \tag{S25}$$

and $$x(T) = \left(v + \frac{Ip_x(\tau_2)}{m}\right)t_a + vt_c - \frac{f(v)t_a^2}{2m} \tag{S26}$$

$$= vT + \frac{2Ip_x(\tau_2)p_y}{m^2g} - \frac{2f(v)p_y^2}{m^3g^2} \simeq vT \tag{S27}$$

after observing that the last two terms of the expression for x(T) are negligeable compared to stride length. Also, one must determine $\overline{v}_0$ as a function of $v=v_0$. To that end, let's introduce factor $\beta$:

$$\sum_i m_i v_i = m\overline{v} = \mu v = \beta m v \tag{S28}$$

Then, at steady running speed:

$$v=\overline{v_0}+\int_0^{\tau_1}\overline{a}dt=\beta v$$

such that:

$$\rightarrow \beta_0 = \frac{\overline{v_0}}{v_0} = \frac{\overline{v_0}}{v} \tag{S29}$$

Using this result and inserting it into Eq. S21 leads to the following equation for the steady state equilibrium maximum velocity due to the angular momentum constraint:

$$v_{AM} = \frac{y_eR - \overline{x_0}}{\frac{\beta_0}{2}t_c + \frac{t_a}{2}(\beta_0 - 1) - \tau_1} \tag{S30}$$

Therefore, the angular momentum constraint becomes:

$$\frac{f(v)}{mg} = \frac{\int_{-\tau_1}^{\tau_2} F_{cx}dt}{\int_{-\tau_1}^{\tau_2} F_{cy}dt} = \frac{1}{y_e}\left[\overline{x_0} + v\left(\frac{\beta_0}{2}t_c + \frac{t_a}{2}(\beta_0 - 1) - \tau_1\right)\right] \tag{S31}$$

Interestingly, both the linear and angular momentum conservation principles lead to different expressions for maximum running velocity. This situation therefore indicates that physics limits maximum running speed and this limit is easily obtained by equating both expressions, that is:

$$v_{LM} = \sqrt{\frac{mg}{\alpha}R_{cr}} \simeq v_{AM} = \frac{y_eR_{cr} - \overline{x_0}}{\frac{\beta_0}{2}t_c + \frac{t_a}{2}(\beta_0 - 1) - \tau_1} = \frac{y_eR_{cr} - \overline{x_0}}{C} \tag{S32}$$

where $v_{LM}$ and $v_{AM}$ are the maximum velocity limits determined from the linear and angular constraints, respectively. This physical constraint hence determines a critical ground impulse ratio $R_{cr}$ given by:

$$y_e^2R^2 - \left(2y_e\overline{x_0} + \frac{mgC^2}{\alpha}\right)R + \overline{x_0}^2 = 0 \tag{S33}$$

$$R = \frac{1}{y_e^2}\left(\left(y_e\overline{x_0} + \frac{mgC^2}{2\alpha}\right) \pm \sqrt{\left(y_e\overline{x_0} + \frac{mgC^2}{2\alpha}\right)^2 - y_e^2\overline{x_0}^2}\right) \tag{S34}$$

whereas it can observe that the impulse ratio reaches a maximum when $\overline{x}_0=0$. Therefore, it occurs that the maximum critical ratio is given:

$$\mathrm{Max}(R) = R_{cr} = \frac{mg}{y_e^2\alpha}\left(\frac{\beta_0}{2}t_c + \frac{t_a}{2}(\beta_0 - 1) - \tau_1\right)^2 \tag{S35}$$

which leads to the following maximum critical velocity that a runner can achieve:

$$v_{cr} = \frac{mg}{y_e\alpha}\left(\frac{\beta_0}{2}t_c + \frac{t_a}{2}(\beta_0 - 1) - \tau_1\right) = \frac{mg}{y_e\alpha}C \tag{S36}$$

where C is called the C-value.

Computation of Drag Factor $\alpha$

The drag coefficient $C_D$ of a human subject standing in a wind tunnel has been measured in the past (e.g. R[30]; R[31]). However, a runner is constantly changing his/her configuration during the step cycle, and different parts of the body see different air speeds during the running cycle, making the process of measuring the runner's drag coefficient a difficult task. Nevertheless, for the purpose of developing the current model, let's assume a constant $C_D$ and a constant frontal area of the runner. The drag factor that is used on the current models is equivalent to the drag coefficient k proposed by R[27] who referenced the equation proposed by R[2], except that a ratio of body frontal area to total body area of 0.31 was used instead of 0.266, and a $C_D$=1.1, based on the work of R[30] or R[1]. Hence, the common drag factor formula is given by:

$$\alpha = \frac{1}{2}\rho_{air} C_D A_f \tag{S37}$$

$$\alpha = \frac{1}{2}\rho_{air} C_D \left[0.2025 \times H^{0.725} \times m^{0.425} \times 0.31\right] \tag{S38}$$

with meters and kilograms as working units. Air density was considered to be equal to 1.225. This equation would certainly need to be revisited for future running studies, since it originated from much earlier work (R[30]; R[5]) where testing conditions were not representative of an athlete in a running situation. R[10] measured the drag factor value of a scaled runner model in a wind tunnel and found a value of about 0.329 for the drag coefficient factor (for a frontal area of 0.6 $m^2$), with about 10% variation between and erect position and a running position. R[15] performed a mathematical time resolution of a lumped parameter model of a runner, with a single mass and a linear damper, including an air resistance proportional to the square of the velocity. They then found a drag coefficient factor of 0.344 (runner 1) or 0.329 (runner 2). These values are in the same order as the estimate from Eq. S37.

Computation of Drag Parameter $y_e$

No existing data was found in the literature that could help estimate parameter $y_e$. Data from R[31] include moment and drag forces that could be of some help, but, as in the drag coefficient, their data were collected in a wind tunnel, with fixed body segments that were exposed to about the same air speed, which is clearly not the case for a runner. Already, however, they showed that the air drag resistance resultant was located higher than the center of mass 90 of the human subjects, i.e. more cranial. Given the complexity of computing $y_e$ 42 with an aerodynamics model, the PA can be used to estimate its value. Knowledge of time period $\tau_1$ and contact time $t_c$ allowed to estimate parameter $y_e$ 42 for each of the three athletes investigated, making use of Eqs (1) and (5), and estimation of the athlete's running speed from the videos. Results vary from 3.335 to 4.412.

Prediction of 100-m Time Based on MRS

One can integrate the equation to obtain a relationship of runner's distance covered as a function of time and $v_{max}$ (or in other words MRS) The inverse function relates the time $t_{100}$ required to complete a 100-m race, to the athlete's MRS, and an explicit function can be obtained if the time constant $\tau$ of the first order system is small compared to $t_{100}$ ($\leq 10$), which is the usually the case in the 100-m race. The inverse function is given by:

$$t_{100} = \frac{100}{v_{max}} + \tau \tag{S39}$$

Prediction of Ground Impulse Ratio or MRS of an Elite Athlete

Recent work by R[27] provides kinematics and kinetics data for the acceleration phase in a 100-m run. Both horizontal and vertical ground impulses were recorded by force platforms for the first 50.5 m of the run, whereas ground impulse is obtained by computing the area under their force-time curves. As runner's maximal velocity is achieved, the impulse ratio progressively decreases. Using their average runner's anthropometry data (65 kg, 1.72 m), the corresponding drag coefficient is found to be $\alpha$=0.369. One can then use the MRS model of Eq. (1) to determine the ground impulse ratio of the athlete at its maximum speed i.e. about 9.75 m/s. It is found that a ratio R=0.055 is required, less than 1% of the ratio estimated by R[27]. With a few manipulations, it can be shown that the resulting critical impulse ratio R here is close the ratio RF computed by R[27].

The MRS of the French runner is said to be in the order of 11.4 m/s. Therefore, using Eq. S36 (with $\alpha$=0.369, $\beta_0$=1, $t_c$=0.1 s, and $y_e$=3.84=mean of our three athletes) one can figure out a value of $\tau_1$=0.028 s at maximum speed.

Prediction of Elite Athletes' MRS

MRS predictions for several 100-m athletes were computed using Eq. S36 and results are shown in Table S4, assuming the following values for the three control inputs: $\beta_0$=1, contact time $t_c$=0.1 s and time constant $\tau_1$=0.028 s. The drag coefficient was computed for each athlete using Eq. S38, while parameter $y_e$ 42 was considered to be the mean of values estimated for the three athletes tested, i.e. $y_e$=3.84. Unfortunately, MRS values for elite athletes are rarely available in the literature. As a validation alternative, since MRS is closely related to the time No required to complete a 100-m race (see Eq. S39), official $t_{100}$ published values are plotted as a function of MRS predictions (see FIG. 5*a*) for athletes listed in Table S4.

Prediction of Elite Athletes' MRS from Linear Momentum Alone

At one point, as runner's velocity increases, the horizonal ground impulse supplied at ground contact point $O_j$ may not be sufficient to counteract the backward impulse created by both the aerodynamic forces 40 and the negative horizontal ground force 45 that occurs when landing at point $O_{j+1}$ (R[27]) over the course of a complete step cycle of duration Ts (Eqs. S8 and S9). At this point, athlete's velocity and limb kinematics are rather stable from one step to another, such that athlete's forward velocity is physically limited by Eq. S13:

$$v_{LM} = \sqrt{\frac{mg}{\alpha}\frac{Ip_x}{Ip_y}} = \sqrt{\frac{mg}{\alpha}R}.$$

Since a minimum vertical ground impulse $Ip_y$ is required to ensure sufficient aerial time to bring the swing leg forward (ballistic lower limb), forward velocity is thus strongly dependent on forward impulse $Ip_x$. This MRS expression is proportional to the square root of the athlete's mass, the gravity and the athlete's ground impulse ratio R, but it is inversely proportional to the square root of the drag coefficient $\alpha$, as defined by R[27]. Hence, lighter athletes may accelerate faster in the first few steps of a 100-m, but they may lose their advantage at one point during the race, because of a lower capacity to reach a higher MRS.

TABLE S1

Key moments of female runner video (65 kg, 1.76 m)

| Event | Approximative Image number on video sequence | Number of images after previous event | Time period with previous event (ms) |
|---|---|---|---|
| First contact | 1323 | N/A | N/A |
| Landing at point $O_j$ | 1364 | N/A | N/A |
| Complete landing | 1576 | 212 | 33 ($t_1$) |
| Takeoff | 2000 | 424 | 66 ($t_2$) |
| Complete takeoff (max contact time = (2112 − 1323)/6400) | 2112 | N/A | $t_c$ = 123 |

TABLE S1-continued

Key moments of female runner video (65 kg, 1.76 m)

| Event | Approximative Image number on video sequence | Number of images after previous event | Time period with previous event (ms) |
|---|---|---|---|
| Landing at point $O_{j+1}$ | 3027 | 1027 | 160 ($t_a$) |
| Complete landing at point $O_{j+1}$ | 3210 | 183 | 29 ($t_1$) |
| Stance leg extension (start) | 1912 | N/A | N/A |
| Stance leg extension (at takeoff) | 2000 | 88 | 14 |
| Drag coefficient α | | 0.324 | |
| Approximate Running velocity (m/s) | | 8.4 | |
| Effective drag height ($y_e$) | | 3.335 | |

Note 1:
contact time is therefore $t_c = t_1 + t_2$ = 33 + 66 = 99 ms, or at maximum 123 ms.
Note 2:
flight time is $t_a$ = 160 ms
Note 3:
Step time T = 66 + 160 + 29 = 255 ms

TABLE S2

Key moments of male A runner video (81.6 kg, 1.84 m)

| Event | Approximative Image number on video sequence | Number of images after previous event | Time period with previous event (ms) |
|---|---|---|---|
| First contact | 2345 | N/A | N/A |
| Landing at point $O_j$ | 2370 | N/A | N/A |
| Complete landing | 2531 | 161 | 25 ($t_1$) |
| Takeoff | 2923 | 392 | 61 ($t_2$) |
| Complete takeoff (max contact time = (2980 − 2345)/6400) | 2980 | N/A | $t_c$ = 99 |
| Landing at point $O_{j+1}$ | 3902 | 979 | 153 ($t_a$) |
| Complete landing at point $O_{j+1}$ | 4139 | 237 | 37 ($t_1$) |
| Stance leg extension (start) | 2849 | N/A | N/A |
| Stance leg extension (at takeoff) | 2923 | 74 | 11.5 |

TABLE S2-continued

Key moments of male A runner video (81.6 kg, 1.84 m)

| Event | Approximative Image number on video sequence | Number of images after previous event | Time period with previous event (ms) |
|---|---|---|---|
| Drag coefficient α | | 0.369 | |
| Approximate Running velocity (m/s) | | 8.95 | |
| Effective drag height ($y_e$) | | 3.768 | |

Note 1:
contact time is therefore $t_c$ = 25 + 61 = 86 or at maximum 99 ms
Note 2:
flight time is $t_a$ = 153 ms
Note 3:
Step time T = 61 + 153 + 37 = 251 ms

TABLE S3

Key moments of male B runner video (60 kg, 1.78 m)

| Event | Approximative Image number on video sequence | Number of images after previous event | Time period with previous event (ms) |
|---|---|---|---|
| First contact | 2164 | N/A | N/A |
| Landing at point $O_j$ | 2169 | N/A | N/A |
| Complete landing | 2352 | 183 | 29 ($t_1$) |
| Takeoff | 2852 | 500 | 78 ($t_2$) |
| Complete takeoff (max contact time = (2888 − 2164)/6400) | 2888 | N/A | $t_c$ = 113 |
| Landing at point $O_{j+1}$ | 3882 | 1030 | 161 ($t_a$) |
| Complete landing at point $O_{j+1}$ | 4136 | 254 | 40 ($t_1$) |
| Stance leg extension (start) | 2782 | N/A | N/A |
| Stance leg extension (at takeoff) | 2852 | 70 | 11 |
| Drag coefficient α | | 0.316 | |
| Approximate Running velocity (m/s) | | 8.93 | |
| Effective drag height ($y_e$) | | 4.412 | |

Note 1:
contact time is therefore $t_c$ = 29 + 78 = 107 ms or at maximum 113 ms
Note 2:
flight time is $t_a$ = 161 ms
Note 3:
Step time T = 61 + 153 + 37 = 251 ms

TABLE S4

List of 100-m runners for analysis

| Name | Year | Mass (kg) | Height (m) | Area ($m^2$) | α ($Ns^2/m^2$) | Time (s) | $v_{cr}$ (m/s) | $R_{cr}$ | $V_{max}$ (m/s) |
|---|---|---|---|---|---|---|---|---|---|
| Carl Lewis | 0 | 80 | 1.88 | 0.55 | 0.32 | 9.92 | 11.83 | 0.0569 | 11.8 |
| Jesse Owens | 0 | 75 | 1.78 | 0.51 | 0.30 | 10.3 | 11.86 | 0.0570 | |
| Tyson Gay | 0 | 75 | 1.80 | 0.52 | 0.30 | 9.69 | 11.76 | 0.0566 | |
| Asafa Powell | 0 | 93 | 1.90 | 0.59 | 0.34 | 9.72 | 12.80 | 0.0615 | 11.9 |
| Maurice Green | 0 | 82 | 1.76 | 0.53 | 0.31 | 9.79 | 12.59 | 0.0605 | 12.1 |
| André De Grasse | 0 | 70 | 1.76 | 0.49 | 0.29 | 9.9 | 11.49 | 0.0553 | |
| Justin Gatlin | 0 | 83 | 1.85 | 0.55 | 0.32 | 9.8 | 12.23 | 0.0588 | |
| Usain bolt | 0 | 94 | 1.95 | 0.60 | 0.35 | 9.58 | 12.64 | 0.0608 | 12.4 |
| Joe Deloach | 0 | 75 | 1.83 | 0.52 | 0.30 | 10.03 | 11.62 | 0.0559 | |
| Lennox Miller | 0 | 79 | 1.83 | 0.53 | 0.31 | 10.04 | 11.98 | 0.0576 | |
| Carlin Isles | 0 | 75 | 1.73 | 0.50 | 0.29 | 10.15 | 12.11 | 0.0582 | |
| Emmanuel Biron | 0 | 65 | 1.77 | 0.48 | 0.28 | 10.17 | 10.97 | 0.0527 | |
| Keysean Powell | 0 | 72.6 | 1.80 | 0.51 | 0.30 | 10.55 | 11.55 | 0.0555 | |
| Akani Simbine | 0 | 74 | 1.76 | 0.51 | 0.29 | 9.89 | 11.87 | 0.0570 | |
| Zhenye Xie | 0 | 78 | 1.84 | 0.53 | 0.31 | 9.97 | 11.84 | 0.0569 | |
| Yuki Koike | 0 | 73 | 1.73 | 0.50 | 0.29 | 9.98 | 11.92 | 0.0573 | |
| Remigiusz Olszewski | 0 | 72 | 1.84 | 0.52 | 0.30 | 10.21 | 11.31 | 0.0544 | |
| Hensley Paulina | 0 | 76 | 1.80 | 0.52 | 0.30 | 10.23 | 11.85 | 0.0570 | |

TABLE S4-continued

List of 100-m runners for analysis

| Name | Year | Mass (kg) | Height (m) | Area ($m^2$) | α ($Ns^2/m^2$) | Time (s) | $v_{cr}$ (m/s) | $R_{cr}$ | $V_{max}$ (m/s) |
|---|---|---|---|---|---|---|---|---|---|
| Linford Christie (GBR) | 1992 | 92 | 1.88 | 0.58 | 0.34 | 9.96 | 12.82 | 0.0616 | |
| Donovan Bailey (CAN) | 1996 | 91 | 1.85 | 0.57 | 0.33 | 9.84 | 12.89 | 0.0620 | |
| Florence Griffith Joyner | 0 | 58 | 1.70 | 0.44 | 0.26 | 10.49 | 10.58 | 0.0509 | |
| Marion Jones | 0 | 68 | 1.78 | 0.49 | 0.29 | 10.65 | 11.21 | 0.0539 | |
| Carmelita Jeter | 0 | 59 | 1.63 | 0.43 | 0.25 | 10.64 | 11.01 | 0.0529 | |
| Sherly Ann Fraser | 0 | 52 | 1.60 | 0.41 | 0.24 | 10.7 | 10.38 | 0.0499 | |
| Elaine Thompson | 0 | 57 | 1.67 | 0.44 | 0.25 | 10.7 | 10.61 | 0.0510 | |
| Christine Arron | 0 | 64 | 1.77 | 0.48 | 0.28 | 10.73 | 10.87 | 0.0523 | |
| Tayne Lawrence | 0 | 57 | 1.63 | 0.43 | 0.25 | 10.93 | 10.80 | 0.0519 | |
| Gina Lucken Kemper | 0 | 57 | 1.70 | 0.44 | 0.26 | 10.95 | 10.47 | 0.0503 | |
| Ge Manqui | 0 | 48 | 1.60 | 0.39 | 0.23 | 11.04 | 9.91 | 0.0477 | |
| Tom Burke (USA) | 1896 | 66 | 1.83 | 0.50 | 0.29 | 12 | 10.80 | 0.0519 | |
| Frank Jarvis (USA) | 1900 | 58 | 1.67 | 0.44 | 0.26 | 11 | 10.71 | 0.0515 | |
| Archie Hahn (USA) | 1904 | 64 | 1.67 | 0.46 | 0.27 | 11 | 11.34 | 0.0545 | |
| Reggie Walker (SAF) | 1908 | 61 | 1.70 | 0.45 | 0.26 | 10.8 | 10.89 | 0.0523 | |
| Ralph Craig (USA) | 1912 | 73 | 1.82 | 0.51 | 0.30 | 10.8 | 11.49 | 0.0552 | |
| Charles Paddock (USA) | 1920 | 75 | 1.71 | 0.50 | 0.29 | 10.8 | 12.21 | 0.0587 | |
| Harold Abrahams (GBR) | 1924 | 75 | 1.83 | 0.52 | 0.30 | 10.6 | 11.62 | 0.0559 | |
| Percy Williams (CAN) | 1928 | 56 | 1.70 | 0.44 | 0.25 | 10.8 | 10.37 | 0.0498 | |
| Eddie Tolan (USA) | 1932 | 65 | 1.70 | 0.47 | 0.27 | 10.38 | 11.29 | 0.0543 | |
| Jesse Owens (USA) | 1936 | 75 | 1.80 | 0.52 | 0.30 | 10.3 | 11.76 | 0.0566 | |
| Harrison Dillard (USA) | 1948 | 69 | 1.78 | 0.49 | 0.29 | 10.3 | 11.31 | 0.0544 | |
| Lindy Remigino (USA) | 1952 | 63 | 1.68 | 0.46 | 0.27 | 10.4 | 11.19 | 0.0538 | |
| Bobby Morrow (USA) | 1956 | 75 | 1.86 | 0.53 | 0.31 | 10.5 | 11.49 | 0.0552 | |
| Armin Hary (GER) | 1960 | 71 | 1.82 | 0.51 | 0.30 | 10.2 | 11.31 | 0.0544 | |
| Bob Hayes (USA) | 1964 | 84 | 1.80 | 0.54 | 0.32 | 10 | 12.56 | 0.0604 | |
| Jim Hines (USA) | 1968 | 81 | 1.83 | 0.54 | 0.31 | 9.95 | 12.15 | 0.0584 | |
| Valeriy Borzov (URS) | 1972 | 80 | 1.83 | 0.54 | 0.31 | 10.14 | 12.06 | 0.0580 | |
| Hasely Crawford (TRI) | 1976 | 90 | 1.87 | 0.57 | 0.33 | 10.06 | 12.71 | 0.0611 | |
| Allan Wells (GBR) | 1980 | 86 | 1.83 | 0.55 | 0.32 | 10.25 | 12.58 | 0.0605 | |

Although the present invention has been described with a certain degree of particularity, it is to be understood that the disclosure has been made by way of example only and that the present invention is not limited to the features of the embodiments described and illustrated herein, but includes all variations and modifications within the scope of the invention as hereinafter claimed.

LIST OF REFERENCES

[1] Aiegren M, Jonsson P. (2018). Drag Area Frontal Area and Drag Coefficient in Cross-Country Skiing Techniques. ISEA 2018 Proceedings, Brisbane, Australia, 2(313): 6 pages.

[2] Arsac L M and Locatelli E (2002). Modeling the energetics of 100-m running by using speed curves of world champions. Journal of Applied Physiology, 92:1781-1788.

[3] Cavanagh P R (1990). Biomechanics of distance running. Human Kinetics Books, Champaign, USA, 362 p.

[4] Coh M, Hébert-Losier K., Stuhec S, Babic V, and Supej M. (2018). Kinematics of Usain Bolt's maximal print velocity. Kinesiology 50:172-180.

[5] Du Bois D and Du Bois E (1916). A formula to estimate the approximate surface area if height and weight be known. Archs Intern Med 17:863-871.

[6] Fenn W O et Morrison C A (1930a). Frictional and kinetic factors in the work of sprint running. 583-611. American J. Phys. 92:583-611.

[7] Fenn W O (1930b). Work against gravity and work due to velocity changes in running. 433-462. American J. Phys. 93:433-462.

[8] Garland, T (1983). The relation between maximal running speed and body mass in terrestrial mammals. J. Zool. Lond. 199:157-170.

[9] Haugen T, McGhie D, Ettema G. (2019). Spring running: from fundamental mechanics to practice—a review.

[10] Hill A V (1928). The Air-Resistance to a Runner. Proceedings of the Royal Society of London. Series B. 102(718):380-385.

[11] Hinrichs R N, Cavanagh P R, Williams K R (1987). Upper extremity function in running. I: Center of mass and propulsion considerations. Int. J. Sport Biomechanics, 3:222-241.

[12] Hinrichs R N (1987). Upper extremity function in running. II: Angular momentum considerations. Int. J. Sport Biomechanics, 3:242-263.

[13] Hogan N (1984). Adaptive Control of Mechanical Impedance bu Coactivation of Antagonist Muscles. IEEE Transactions Automatic Control, AC-29(8):681-690.

[14] Irving, M (2017). Regulation of Contaction by the Fhick Filaments in Skeletal Muscle. Biophysical Journal, 113:2579-2594.

[15] Kyle C R and Caiozzo V J (1986). The effect of athletic clothing aerodynamics upon running speed. Medicine and Science in Sports and Exercise. 18(5):509-515.

[16] Krzysztof M, Mero A. (2013). A kinematics analysis of three best 100-m performances ever. J. Human Kinetics, 36:149-160.

[17] Lee H, Hogan N (2015). Time-Varying Ankle Mechanical Impedance During Human Locomotion, IEEE Transactions on Neural Systems and Rehabilitation Engineering, 23(5):755-764.

[18] Majumdar A S, Robergs R A (2011). The Science of Speed: Determinants of Performance in the 100 m Sprint. Int. J. Sports Sciences & Coaching, 6(3):479-493.

[19] Mann R V and Murphy A (2018). The Mechanics of Sprinting and Hurdling, 329 pages.

[20] Marey E.-J. (1883a). Emploi des photographies partielles pour étudier la locomotion de l'homme et des animaux (séance du 25 juin). Comptes Rendus Hebdomadaires des Séances de l'Académie des Sciences, vol. 96, no 26, pp. 1827-1831.

[21] Marey E.-J. (1883b). De la mesure des forces dans les différents actes de la locomotion (I).—De la mesure des forces dans les différents actes de la locomotion (II) (séances des 8 et 15 octobre). Comptes Rendus Hebdomadaires des Séances de l'Académie des Sciences, vol. 97, no 15, pp. 782-786; no 16, pp. 820-825.

[22] McMahon T A, Greene P R (1979). The influence of track compliance on running. J. Biomechanics, 12:893-904.

[23] McMahon T A, Cheng G C (1990). The mechanics of running: how does stiffness couple with speed. J. Biomechanics, 23, suppl 1:65-78.

[24] Mero A, Komi P V and Gregor R J (1992). Biomechanics of spring running. Sports Medicine 13(6):376-392.

[25] Moore I S (2016). Is there an economical running technique? A review of modifiable biomechanical factors affecting running economy. Sports Med, 6:793-807.

[26] Morin J B, Bourdin P E, Peyrot N, Samozino P, Lacour J R (2012). Mechanical determinants of 100-m spring running performance.

[27] Morin J B, Samozino P, Murata M, Cross M R, Nagahara R (2019). A simple method for computing sprint acceleration kinetics from running velocity data: replication study with improved design. J. Biomechanics, 94:82-87.

[28] Mussa-Ivaldi S, Hogan N (1989). Solving kinematic redundancy with impedance control: a class of integrable pseudoinverses. IEEE International Conference on Robotics and Automation, Scottsdale, A Z, pp. 283-288.

[29] Novacheck T F (1998). The biomechanics of running. Gait and Posture, 7:77-95.

[30] Penwarden A D, Grigg P F and Rayment R (1978). Measurements of wind drag on people standing in a wind tunnel. Building and Environment, 13:75-84.

[31] Schmitt, T J (1954). Wind tunnel investigation of air loads on human beings. U S Navy Department, A D 491201, Report 892, Aero 858.

[32] Weyand P G, Sternlight D B, Bellizi M J and Wright S (2000). Faster top running speeds are achieved with greater ground forces not more rapid leg movements. J. Appl. Physiol., 89:1991-1999.

[33] Weyand P G, Sandell R F, Prime D N L, Bundle M W (2010) The biological limits to running speed are imposed from the group up. J. Appl Physiol 108:950-961.

[34] Williams J H (1996). Fundamentals of applied dynamics. John Wiley & Sons. 854 p.

The invention claimed is:

1. A system for predicting a maximum running speed (MRS) of a runner as a first predictive outcome (PO), said system comprising:

a memory unit (MU) having stored therein a plurality of running determinants (RDs) of the runner and venue;

a processor unit (PU) connecting to the memory unit (MU), the processor unit (PU) running a predictive algorithm (PA) using the plurality of running determinants (RDs) to predict the maximum running speed of the runner by zeroing a linear momentum balance and an angular momentum balance of the runner, along with an estimated value of at least one of the plurality of running determinants and an additional running determinant; and an output unit (OU) connecting to the processor unit (PU) to receive the predicted maximum running speed therefrom, along with the estimated value and at least one corresponding feedback action for the runner to implement to get closer to the estimated value and therefore to the predicted maximum running speed.

2. The system of claim 1, wherein the zeroing of the linear momentum balance and the angular momentum balance allows the processor unit (PU) to determine a critical ground impulse ratio ($R_{cr}$) of the runner as a second predictive outcome (PO) sent to the output unit (OU).

3. The system of claim 1, wherein at least one of the first and second predictive outcomes (PO) is stored in a performance result database (PRD).

4. The system of claim 1, wherein the plurality of running determinants (RDs) and the additional running determinant are stored in a parameter database (PD) including environmental characteristics (ECs) and runner's characteristics (RCs) and a control inputs database (CID) including runner's control inputs (RCIs).

5. The system of claim 4, wherein the environmental characteristics (ECs) include a gravitational acceleration (g), a wind speed ($v_w$), an air density ($\rho$), and track ($Z_{trk}$) and shoe ($Z_{shoe}$) mechanical impedances, wherein the runner's characteristics (RCs) include a body mass (m) of the runner, an effective drag factor ($\alpha$), an effective drag force height ($y_e$), and body segments' lengths, mass, inertia, and center of mass locations of the runner, and wherein the runner's control inputs (RCIs) include one of a contact time ($t_c$) value and a takeoff time period ($\tau_2$) value, an aerial time ($t_a$) value, a landing time period ($\tau_1$) value, and a center of mass speed ratio ($\beta_0$) value.

6. The system of claim 1, further comprising:

a ground instrumentation unit (GIU) connecting to the processor unit (PU) to capture motion data from the runner while running at constant speed;

wherein the processor unit (PU) receives the captured motion data to determine real-time values of a portion of the plurality of running determinants (RDs) and the additional running determinant and provide therewith real-time values of the predictive outcomes (PO).

7. The system of claim 6, wherein the portion of the plurality of running determinants (RDs) and the additional running determinant includes at least one of the effective drag factor ($\alpha$), the effective drag force height ($y_e$), one of the contact time ($t_c$) value and the takeoff time period ($\tau_2$) value, the aerial time ($t_a$) value, the landing time period ($\tau_1$) value, and the center of mass speed ratio ($\beta_0$) value.

8. The system of claim 6, further comprising:

a system identification unit (SIU) connecting to the processor unit (PU) to receive the predictive outcomes (PO) therefrom, the system identification unit (SIU) estimating at least one of the plurality of running determinants (RDs) and sending the estimated one of the plurality of running determinants (RDs) to the memory unit (MU) connected to the system identification unit (SIU).

9. The system of claim 3, wherein at least one of the plurality of running determinants (RDs) and the additional running determinant is determined from a plurality of accumulated tabled values from other runners and stored in the performance result database (PRD).

10. The system of claim 3, further comprising:

an optimization algorithm (OA) connecting to the performance result database (PRD) to receive data therefrom to determine optimized values of at least one of the plurality of running determinants (RDs) and the additional running determinant to improve the predictive outcomes (PO) and sending the optimized values to the memory unit (MU) connected to the optimization algorithm (OA).

11. The system of claim 10, wherein the plurality of running determinants (RDs) and the additional running determinant are stored in a parameter database (PD) including environmental characteristics (ECs) and runner's characteristics (RCs) and a control inputs database (CID) including runner's control inputs (RCIs); and wherein the optimization algorithm (OA) determines optimal values of the runner's control inputs (RCIs) to achieve a predetermined value of at least one of the first and second predictive outcomes (PO) using the environmental characteristics (ECs) and runner's characteristics (RCs).

12. The system of claim 11, wherein the optimization algorithm (OA) determines optimal values of the environmental characteristics (ECs), runner's characteristics (RCs), and the runner's control inputs (RCIs) to achieve an ultimate predetermined value of at least one of the first and second predictive outcomes (PO).

13. The system of claim 1, wherein the zeroing of the linear momentum balance and the angular momentum balance is performed over at least a half-running cycle (HRC).

14. A method for predicting a maximum running speed (MRS) of a runner as a first predictive outcome (PO), said method comprising the steps of:

getting a plurality of running determinants (RDs) of the runner and venue stored in a memory unit (MU);

running a predictive algorithm (PA) with a processor unit (PU) connected to the memory unit (MU) using the plurality of running determinants (RDs) to predict the maximum running speed of the runner by zeroing a linear momentum balance and an angular momentum balance of the runner, along with an estimated value of at least one of the plurality of running determinants and an additional running determinant; and providing the predicted maximum running speed to an output unit (OU) connected to the processor unit (PU), along with the estimated value and at least one corresponding feedback action for the runner to implement to get closer to the estimated value and therefore to the predicted maximum running speed.

15. The method of claim 14, wherein the zeroing of the linear momentum balance and the angular momentum balance allows determining a critical ground impulse ratio ($R_{cr}$) of the runner as a second predictive outcome (PO), and wherein the step of providing comprises providing the second predictive outcome (PO) to the output unit (OU).

16. The method of claim 14, further comprising the step of:

storing the at least one of the first and second predictive outcomes (PO) in a performance result database (PRD).

17. The method of claim 14, wherein the plurality of running determinants (RDs) and the additional running determinant are stored in a parameter database (PD) including environmental characteristics (ECs) and runner's characteristics (RCs) and a control inputs database (CID) including runner's control inputs (RCIs); and wherein the environmental characteristics (ECs) include a gravitational acceleration (g), a wind speed ($v_w$), an air density ($\rho$), and track ($Z_{trk}$) and shoe ($Z_{shoe}$) mechanical impedances, wherein the runner's characteristics (RCs) include a body mass (m) of the runner, an effective drag factor ($\alpha$), an effective drag force height ($y_e$), and body segments' lengths, mass, inertia, and center of mass locations of the runner, and wherein the runner's control inputs (RCIs) include one of a contact time ($t_c$) value and a takeoff time period ($\tau_2$) value, an aerial time ($t_a$) value, a landing time period ($\tau_1$) value, and a center of mass speed ratio ($\beta_0$) value; the method further comprising the steps of:

capturing motion data from the runner while running at constant speed using a ground instrumentation unit (GIU) connected to the processor unit (PU);

determining real-time values of a portion of the plurality of running determinants (RDs) and the additional running determinant with the captured motion data received from the processing unit (PU), and providing therewith real-time values of the predictive outcomes (PO).

18. The method of claim 17, wherein the portion of the plurality of running determinants (RDs) and the additional running determinant includes at least one of the effective drag factor ($\alpha$), the effective drag force height ($y_e$), one of the contact time ($t_c$) value and the takeoff time period ($\tau_2$) value, the aerial time ($t_a$) value, the landing time period ($\tau_1$) value, and the center of mass speed ratio ($\beta_0$) value; the method further comprising the step of:

estimating at least one of the plurality of running determinants (RDs) using a system identification unit (SIU) connected to the processor unit (PU) to receive the predictive outcomes (PO) therefrom, and sending the estimated one of the plurality of running determinants (RDs) to the memory unit (MU) connected to the system identification unit (SIU).

19. The method of claim 16, wherein at least one of the plurality of running determinants (RDs) and the additional running determinant is determined from a plurality of accumulated tabled values from other runners and stored in the performance result database (PRD).

20. The method of claim 16, further comprising the step of:

determining optimized values of at least one of the plurality of running determinants (RDs) and the additional running determinant, using an optimization algorithm (OA) connected to the performance result database (PRD) to receive data therefrom, to improve the predictive outcomes (PO), and sending the optimized values to the memory unit (MU) connected to the optimization algorithm (OA).

21. The method of claim 20, wherein the plurality of running determinants (RDs) and the additional running determinant are stored in a parameter database (PD) including environmental characteristics (ECs) and runner's characteristics (RCs) and a control inputs database (CID) including runner's control inputs (RCIs); the method further comprising the step of:

determining optimal values of the runner's control inputs (RCIs) using the optimization algorithm (OA) to achieve a predetermined value of at least one of the first and second predictive outcomes (PO) using the environmental characteristics (ECs) and runner's characteristics (RCs).

22. The method of claim 21, further comprising the step of determining optimal values of the environmental characteristics (ECs), runner's characteristics (RCs), and the runner's control inputs (RCIs) using the optimization algorithm (OA) to achieve an ultimate predetermined value of at least one of the first and second predictive outcomes (PO).

23. The method of claim 14, wherein the zeroing includes zeroing of the linear momentum balance and the angular momentum balance over at least a half-running cycle (HRC).

* * * * *